US008033890B2

(12) United States Patent
Warner et al.

(10) Patent No.: US 8,033,890 B2
(45) Date of Patent: Oct. 11, 2011

(54) SELF-PROPELLED HYDRODYNAMIC UNDERWATER TOY

(76) Inventors: Jon A. Warner, Santa Barbara, CA (US); John Yi, Moyock, NC (US)

( * ) Notice: Subject to any disclaimer, the term of this patent is extended or adjusted under 35 U.S.C. 154(b) by 637 days.

(21) Appl. No.: 11/435,286

(22) Filed: May 17, 2006

(65) Prior Publication Data

US 2007/0123139 A1 May 31, 2007

Related U.S. Application Data

(60) Provisional application No. 60/684,801, filed on May 18, 2005.

(51) Int. Cl.
*A63H 23/04* (2006.01)
*A63H 23/06* (2006.01)

(52) U.S. Cl. ..... 446/161; 446/163

(58) Field of Classification Search ..... 446/160–163, 446/176, 185–187, 193, 196, 197
See application file for complete search history.

(56) References Cited

U.S. PATENT DOCUMENTS

| | | | | |
|---|---|---|---|---|
| 16,819 | A | 3/1857 | Scholfield et al. | |
| 1,200,960 | A | 10/1916 | McHugh | |
| 1,243,287 | A | 10/1917 | Haigh | |
| 1,297,273 | A | 3/1919 | Straub et al. | |
| 1,410,872 | A | 3/1922 | Baldwin | |
| 1,544,003 | A | 6/1925 | Henderson | |
| 1,595,828 | A | 8/1926 | Fuller | |
| 1,673,479 | A * | 6/1928 | Allen | 446/156 |
| 1,893,507 | A | 1/1933 | Leo | |
| 1,903,805 | A | 4/1933 | Buckley | |
| 1,994,490 | A | 3/1935 | Skinner | |
| 2,076,428 | A * | 4/1937 | Drudy, Jr. et al. | 446/163 |
| 2,101,646 | A * | 12/1937 | Gordon, Jr. | 446/163 |
| 2,299,551 | A | 10/1942 | McGahey | |
| 2,364,197 | A | 12/1944 | Dee | |

(Continued)

FOREIGN PATENT DOCUMENTS

GB 5159 0/1898

(Continued)

OTHER PUBLICATIONS

International Search Report and Written Opinion for PCT/US06/19345, mailed Sep. 26, 2007; 8 pages.

(Continued)

*Primary Examiner* — Gene Kim
*Assistant Examiner* — Alyssa Hylinski
(74) *Attorney, Agent, or Firm* — Cooley LLP

(57) ABSTRACT

Self-propelled hydrodynamic underwater toys with integrated propulsion mechanisms are described. In some embodiments, the propulsion mechanisms is partially or completely within an internal compartment in the toy's body. The propulsion mechanisms are adapted to be charged with a volume of fluid and to thereafter discharge the volume of fluid under pressure to propel the toy through a body of water. In some embodiments, the propulsion mechanism includes an expandable reservoir. In some embodiments, the propulsion mechanism is a replaceable propulsion mechanism. In some embodiments, the toy includes a trajectory-stabilizing structure that is adapted to impart at least one of a steering moment and a righting moment to the toy during underwater travel. The toy may be adapted to have positive, negative or neutral buoyancies, and can be adapted to maintain its buoyancy and/or its center of gravity while being propelled through a body of water by the propulsion system.

22 Claims, 26 Drawing Sheets

U.S. PATENT DOCUMENTS 2,405,715 A * 8/1946 Sabini ..... 446/161
2,410,682 A * 11/1946 Richardson ..... 446/163
2,459,357 A 1/1949 Bell
2,480,927 A 9/1949 Hopkins
2,494,026 A 1/1950 Anderson
2,505,526 A * 4/1950 Costea ..... 446/187
2,511,323 A 6/1950 Briggs et al.
2,661,571 A * 12/1953 Ramsay ..... 446/163
2,671,398 A 3/1954 Peck
2,826,001 A * 3/1958 Presnell ..... 446/161
2,848,945 A 8/1958 Brunbaugh
2,857,709 A 10/1958 Weiland
2,881,558 A 4/1959 Bell
2,892,409 A 6/1959 Lyon
2,906,531 A 9/1959 Merickel et al.
2,925,276 A 2/1960 Leclerc
2,943,568 A 7/1960 Pavian
2,984,181 A 5/1961 Baldwin, Jr.
3,007,410 A 11/1961 Blacker
3,015,269 A 1/1962 Potts, Jr.
3,060,854 A 10/1962 Maretti
3,066,441 A 12/1962 Morse
3,141,434 A 7/1964 Van Billiard
3,150,625 A 9/1964 Brooks
3,157,145 A 11/1964 Farris et al.
3,181,272 A 5/1965 Gibson
3,183,002 A 5/1965 Updaw
3,193,967 A 7/1965 Okonski
3,194,201 A 7/1965 Lang
3,196,823 A 7/1965 Thurston
3,216,727 A 11/1965 Hunter
3,225,488 A 12/1965 Goldfarb
3,242,613 A * 3/1966 Schwartz ..... 446/162
3,251,154 A 5/1966 Taylor
3,392,693 A 7/1968 Hulsebos et al.
3,434,425 A 3/1969 Critcher
3,435,796 A 4/1969 Merrill
3,466,798 A 9/1969 Speers et al.
3,516,358 A 6/1970 Manninen et al.
3,532,300 A 10/1970 Bucklisch at al.
3,544,113 A 12/1970 Hand
3,571,966 A 3/1971 Phelps
3,575,123 A 4/1971 Shepherd et al.
3,727,570 A 4/1973 Molinski
3,746,334 A 7/1973 Stubblefield
3,754,349 A 8/1973 Wallace
3,853,320 A 12/1974 Carella
3,915,092 A 10/1975 Monson et al.
3,916,560 A 11/1975 Becker
4,004,514 A 1/1977 Daniels
4,021,041 A 5/1977 Goldfarb et al.
4,052,812 A 10/1977 Kupperman et al.
4,109,579 A 8/1978 Carter
4,129,086 A 12/1978 Schwarz
4,144,669 A 3/1979 Ogawa
4,153,223 A 5/1979 Romer et al.
4,241,535 A 12/1980 Tsukuda
4,260,341 A * 4/1981 Rolsten ..... 417/454
4,274,223 A 6/1981 Morrison et al.
4,346,662 A 8/1982 Rogers
4,374,493 A 2/1983 Hoffing
4,395,965 A 8/1983 Lang
4,448,106 A 5/1984 Knapp
4,463,954 A 8/1984 Panse et al.
4,478,148 A 10/1984 Applebaum et al.
4,563,161 A 1/1986 Zimmerman
4,569,300 A 2/1986 Ferris et al.
4,674,706 A 6/1987 Hall
H329 H 9/1987 Bahnck
4,748,912 A 6/1988 Garcia
4,826,465 A 5/1989 Fleischmann
4,964,593 A 10/1990 Kranz
4,978,088 A 12/1990 Himmert et al.
4,979,922 A 12/1990 Clark
5,052,725 A 10/1991 Meyer et al.
5,080,017 A 1/1992 Asikainen
5,125,344 A 6/1992 Kline et al.
5,129,325 A 7/1992 Matzagg
5,203,732 A 4/1993 Cusson
5,224,665 A 7/1993 Goldsberry et al.
5,269,514 A 12/1993 Adler et al.
5,306,191 A 4/1994 Phillips et al.
5,400,712 A 3/1995 Herbage et al.
5,498,160 A 3/1996 Farina et al.
5,514,023 A 5/1996 Warner
5,725,179 A 3/1998 Gilman et al.
5,865,662 A 2/1999 Dammann
5,882,240 A 3/1999 Larsen
6,146,292 A 11/2000 Yamanaka
6,280,277 B1 8/2001 Greenberg et al.
6,699,091 B1 3/2004 Warner
6,860,785 B2 * 3/2005 Vap ..... 446/153
6,921,315 B2 * 7/2005 Kownacki ..... 446/162
6,926,577 B2 * 8/2005 Thorne, III ..... 446/161
2002/0187866 A1 * 12/2002 Touhey et al. ..... 473/593
2004/0235387 A1 * 11/2004 Thorne, III ..... 446/153

FOREIGN PATENT DOCUMENTS

GB 2088226 6/1982
GB 2195261 4/1988
SU 1087143 A 4/1984
WO WO 9109657 A1 * 7/1991

OTHER PUBLICATIONS

Photographs of Toypedo toy and packaging, 1997.
Photographs of Poolatis toy and packaging, 1998.
Water Warehouse catalog, 2 pages, Spring 1999.

* cited by examiner

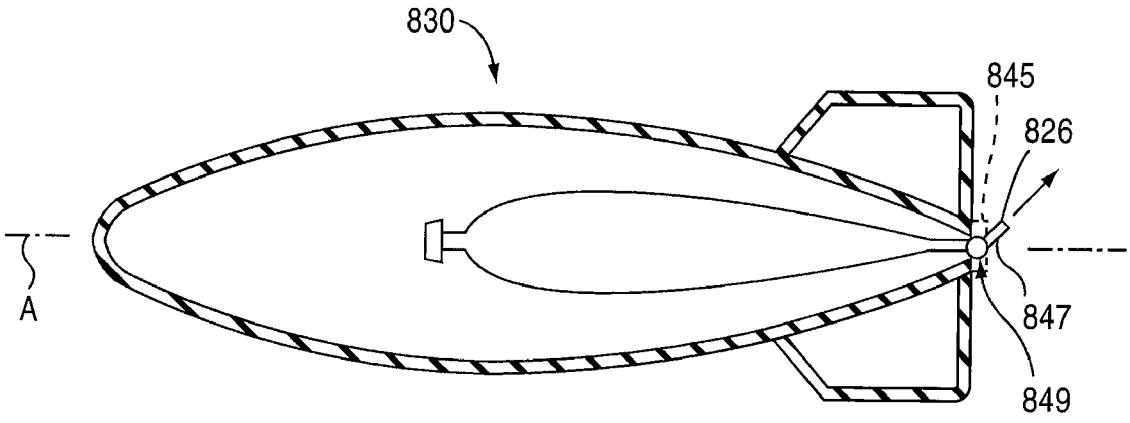
Fig.25
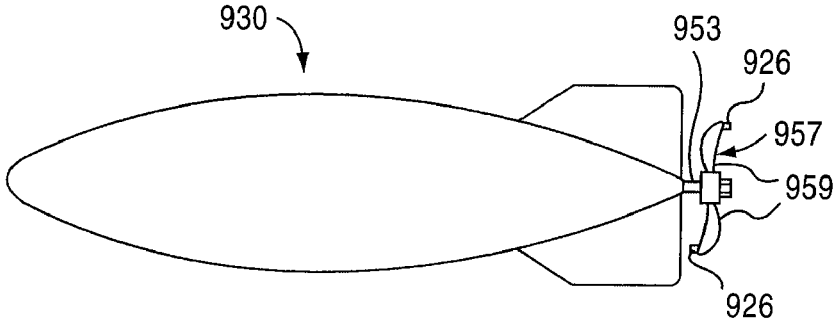
Fig.26
Fig.27
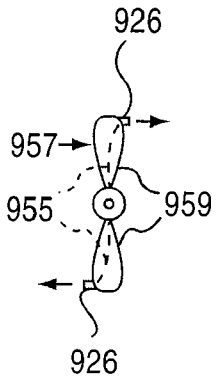

SELF-PROPELLED HYDRODYNAMIC UNDERWATER TOY

CROSS-REFERENCE TO RELATED APPLICATIONS

This application claims priority to U.S. Provisional Application Ser. No. 60/684,801, entitled "Self-Propelled Hydrodynamic Underwater Toy," filed May 18, 2005, the disclosure of which is hereby incorporated by reference in its entirety.

BACKGROUND

The disclosure generally relates to toys for use in water, and more particularly to hydrodynamic toys adapted to be launched for self-propelled travel through an underwater trajectory.

Aerodynamic toys capable of being hand-launched through the air have been known for many years, and include balls, flying discs, boomerangs, toy gliders, etc. Aerodynamic toys typically are characterized by a combination of properties allowing a user to launch the toy into the air by hand so that the toy travels a substantial distance through the air along a trajectory selected by the user. Specifically, each of these toys has a size and shape that, in relation to the weight of the toy, enables an average user to apply a launching momentum sufficient to overcome, at least temporarily, the forces of gravity and wind-drag on the toy. Some aerodynamic toys are also configured to create lift when launched through the air to increase the distance the toys travel before descending to the ground.

While hand-launchable, aerodynamic toys are well-suited for use in air, they are not well-suited for use underwater. For example, objects traveling through water experience a significantly higher amount of drag than do objects traveling through air, because water has a much higher density than air. Similarly, objects experience greater buoyancy in water than in air due to the higher specific gravity of water than air. For these reasons, toys intended for use underwater should employ hydrodynamic rather than aerodynamic values and thus, typically will have different combinations of size, shape, and weight, than those intended for use in air. In U.S. Pat. Nos. 5,514,023 and 6,699,091, the disclosures of which are hereby incorporated by reference, various hand-launchable projectile toys are disclosed that are hydrodynamically configured to travel substantial distances underwater. The toys include elongate, contoured bodies that include fins or other trajectory-stabilizing structures that project from the tail section of the body. In some embodiments, the trajectory-stabilizing structure is adapted to impart a righting moment to the toy during underwater travel, while in others the structure is adapted to impart a steering moment to the toy during underwater travel.

These underwater toys are adapted to be hand-launched through a pool or other body of water, with the particular configuration, construction, and/or buoyancy of the toy affecting its hydrodynamic path through the body of water. The hand-launchable size and geometry of the toys enable them to be grasped in a user's hand, such as in the notch formed by the user's thumb and index finger, and manually propelled through the body of water. However, some users may lack sufficient strength, size and/or coordination to effectively launch these toys along a suitable underwater path through the body of water. Others simply may desire an underwater toy that does not require manual propulsion through the body of water.

SUMMARY OF THE INVENTION

Self-propelled hydrodynamic toys adapted to travel along an underwater trajectory via propulsion provided by the toy are disclosed. In some embodiments, the propulsion mechanism is partially housed within an internal compartment in the toy's body. In some embodiments, the propulsion mechanism is completely housed within am internal compartment of the toy's body. In some embodiments, the propulsion mechanism is adapted to be charged with a volume of water and to thereafter discharge the volume of water under pressure to propel the toy through a body of water. In some embodiments, the propulsion mechanism includes an expandable reservoir. In some embodiments, the propulsion mechanism includes a biased propulsion mechanism. In some embodiments, the propulsion mechanism is a replaceable propulsion mechanism. In some embodiments, the toy includes trajectory-stabilizing structure that is adapted to impart at least one of a steering moment and a righting moment to the toy during underwater travel. The toy may be adapted to have positive, negative or neutral buoyancies, and in some embodiments is adapted to maintain its buoyancy and/or its center of gravity and/or its center of buoyancy while the toy is being propelled through a body of water by the propulsion system.

BRIEF DESCRIPTION OF THE INVENTION

FIG. 25 is a side cross-sectional view of another toy according to an embodiment of the invention.

FIG. 26 is a side elevation view of another toy according to an embodiment of the invention.

FIG. 27 is an end elevation view of the propeller shown in FIG. 26.

DETAILED DESCRIPTION

Figure 1:
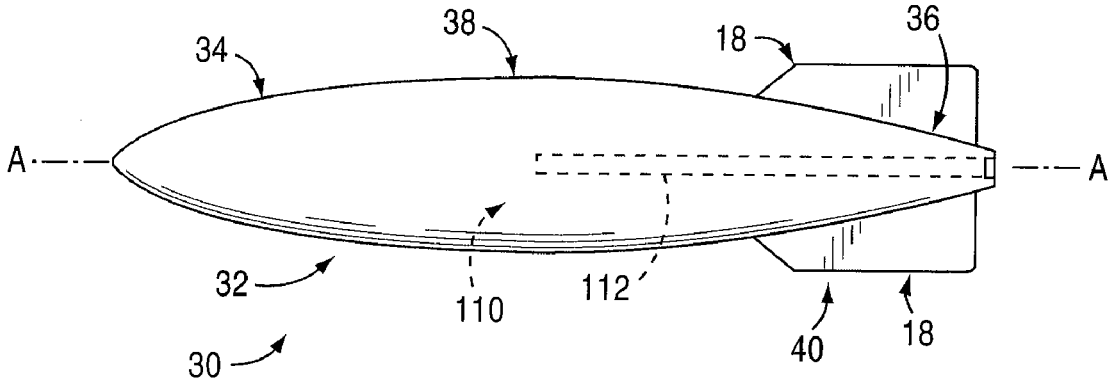
FIG. 1 is a side elevation view of a hydrodynamic toy according to an embodiment of the invention.
Figure 2:
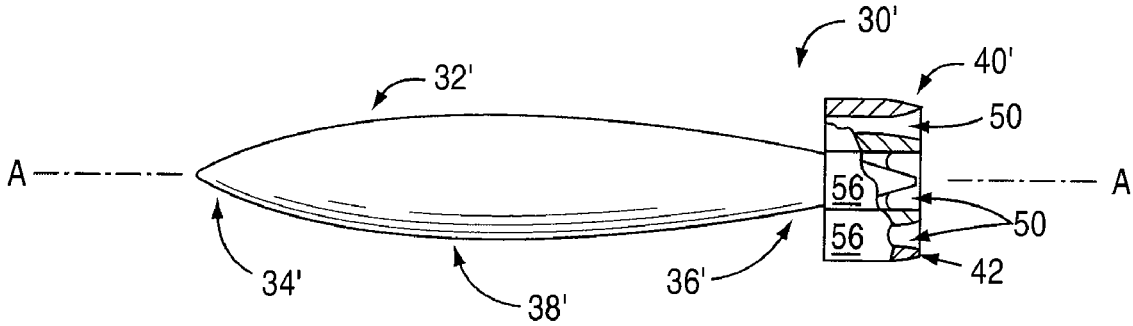
FIG. 2 is a side elevation view of another example of a hydrodynamic toy according to an embodiment of the invention.
Figure 3:
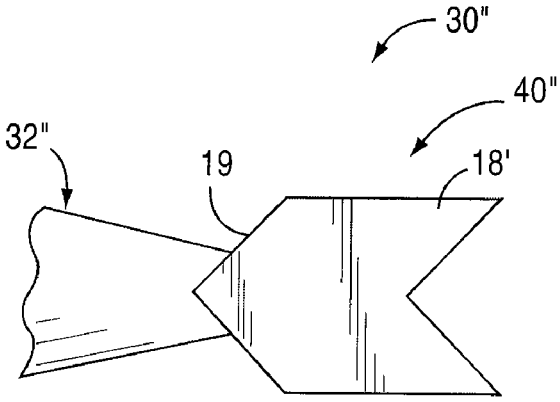
FIG. 3 is a fragmentary side elevation view of another example of a hydrodynamic toy according to an embodiment of the invention.

Examples of self-propelled underwater toys according to embodiments of the invention are shown in FIGS. 1-3 and indicated generally at 30, 30' and 30" (collectively also referred to as toy 30). Toys 30 are adapted for use in water, and perhaps more particularly, to be propelled through a body of water, such as a pool, by a propulsion mechanism of the toy. As such, toys 30 are constructed and configured to have selected hydrodynamic properties to adapt the toys for repeated underwater use. As indicated in FIGS. 1 and 2, toy 30, 30' include a body 32, 32' having a nose section 34, 34', a tail section 36, 36', and a mid-section 38, 38' extending therebetween. As used herein, "nose section" refers to the forward, or leading, portion of the toy as the toy is propelled through a body of water, and "tail section" refers to the aft, or rearward, section of the toy. In other words, the tail section follows the nose section of the toy as the toy is propelled through a body of water by the subsequently described propulsion mechanism.

In FIGS. 1-3, the toys 30 are shown including a directional trajectory-stabilizing structure 40, 40', 40" (also referred to as "stabilizing structure" or "stabilizer") extending from the tail section of body 32, 32', 32". As shown, stabilizing structure 40, 40', 40" includes one or more drag-producing surfaces that are adapted to impart a righting moment to the body during underwater travel. Additionally or alternatively, stabilizing structures 40, 40', 40" can include at least one portion that is adapted to impart a selected steering moment to the body during underwater travel, thus providing additional possibilities for underwater performance. In FIG. 1, stabilizing structure 40 takes the form of multiple fins 18 that extend from the body 32. As illustrated, the fins 18 extend in a radial configuration relative to the long axis A of the body 32. In other embodiments, different numbers and/or configurations of fins 18 can be included, including fewer than four fins, more than four fins, larger fins, smaller fins, adjustable fins and/or removable fins.

In FIG. 2, stabilizing structure 40' takes the form of a fin 42. As illustrated, the fin 42 has an annular, or ring, configuration. In other embodiments, other configurations and/or sizes of fins can be included, including, for example, different types of foils such as box foils, ring foils, foils having a polygonal configuration with more or less than four sides, etc. As illustrated, fin 42 includes drag-producing surfaces 56 and defines at least one flow channel 50 through which water may flow through the foil and external to the body 32' of the toy 30' as the toy 30' travels through water. A further example of a suitable stabilizing structure is shown in FIG. 3. As shown, stabilizing structure 40" includes fins 18', which are coupled to the body 32", such as by extending from the body 32" or being interconnected to the tail section of the body 32" by one or more supports (not shown). Fins 18' can be pivotally mounted relative to the body 32" to allow the user to adjust the angular position of one or both fins 18' relative to the supports. Although shown as being generally arrow-shaped, fins 18' alternatively can be formed in any desired shape, such as round or rectilinear. It will be appreciated that the magnitudes of the righting moments and/or steering moments created by the drag-producing surfaces 19 of the fins 18' will depend upon the size of the fins. In addition, supports can also produce righting, and/or steering moments depending on their sizes and configurations.

Additional illustrative, non-exclusive examples of suitable stabilizing structures are disclosed in U.S. Pat. Nos. 5,514,023 and 6,699,091, the complete disclosures of which are hereby incorporated by reference. Similarly, the internal compartment and propulsion mechanism described herein can be implemented in any of the toys disclosed in the above-incorporated patents. In some embodiments, the toy is formed without a stabilizing structure.

Figure 42:
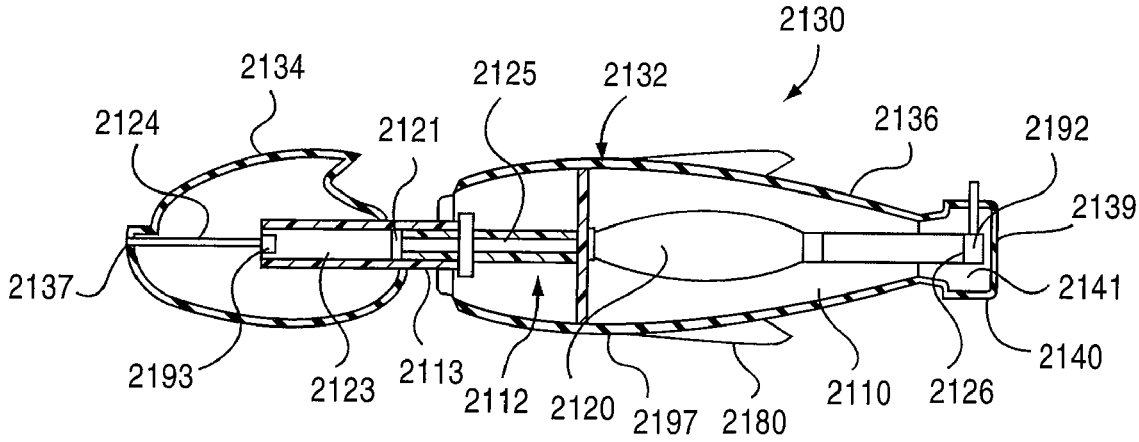
FIG. 42 is a side view shown partially in cross-section of a toy in an extended configuration according to another embodiment of the invention.
Figure 43:
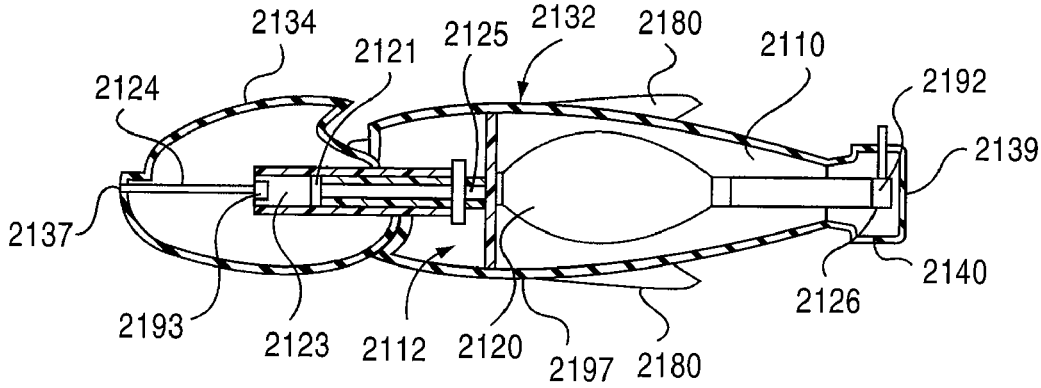
FIG. 43 is a side view of the toy of FIG. 42 shown in a collapsed configuration.
Figure 44:
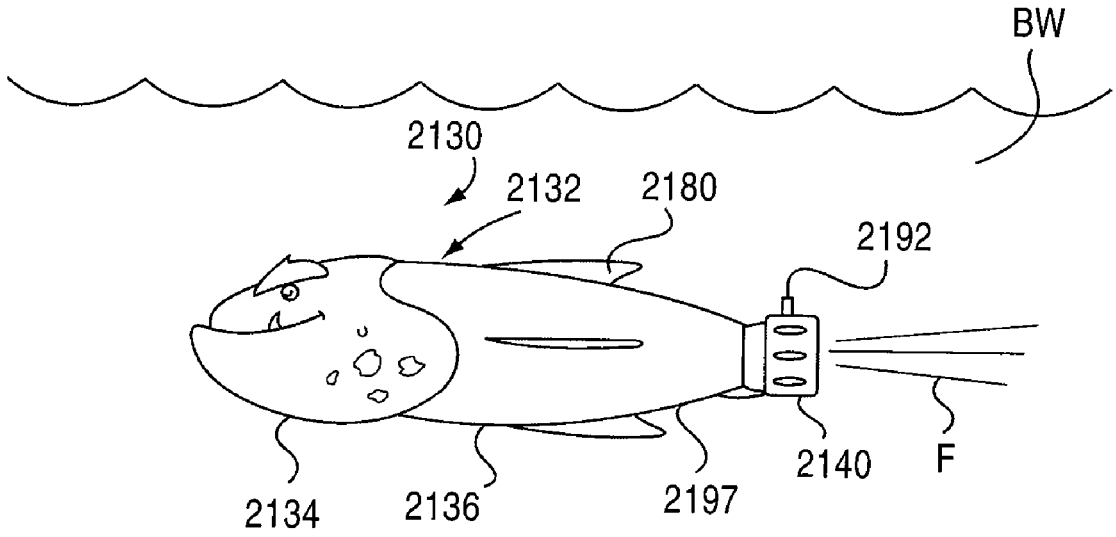
FIG. 44 is a side view of the toy of FIGS. 42 and 43 shown being propelled in a body of water.

The toys 30, 30', 30" can be constructed with various hydrodynamic shapes and configurations. In the embodiments of at least FIGS. 1 and 2, toys 30, 30' are depicted having a torpedo-like shape. In these illustrated examples, body 32, 32' are at least substantially symmetrical about a longitudinal central axis A, and has an elongate, smoothly contoured form adapted to glide easily through water. As shown, nose section 34, 34' is gently arcuately tapered with a generally parabolic cross-sectional profile. Other selected profiles can be used in other embodiments. Similarly, body 32, 32', 32" may be shaped to resemble less projectile-like structures, such as animals, fish, humans, and the like, such as shown in the embodiment of FIGS. 42-44.

In FIGS. 1 and 2, mid-section 38, 38' is illustrated as having a generally circular cross-sectional configuration. However, it should be understood that other cross-sectional configurations can also be used. For example, the cross-section of mid-section can be triangular, rectilinear, polygonal, oval, elliptical, or any other suitable shape. At least a portion of mid-section 38, 38' of the illustrative examples shown in FIGS. 1 and 2 is sized to allow a user to easily grasp the mid-section in his or her hand by extending the thumb and one or more fingers at least partially around the mid-section. This grasping position allows the user to launch the projectile toy similar to launching a spear. However, as toys 30, 30', 30" can also be adapted to be propelled through the body of water via an integrated propulsion mechanism instead of solely by propulsion generated by a user throwing the toy through the body of water, the mid-section of the toy may be formed without this grasping portion.

An outer surface of body 32, 32', 32" may be smooth, or may alternatively include topographic features such as ribbing, grooves, projections, protrusions, etc. Such features can be uniformly distributed over the surface of body, or may be arranged in a non-uniform pattern or distribution. As one example, a toy can include ribbing or grooves (not shown) extending generally spirally around the body.

Body 32, 32', 32" can be constructed to different sizes and proportions, with the dimensions disclosed in the above-incorporated patents being suitable, but not exclusive, examples. For example, in one embodiment, body 32, 32', 32" can have a length of approximately sixteen inches and a maximum diameter of approximately 2.7 inches, for a length-to-width ratio of approximately 5.9:1. Other lengths, widths, and/or length-to-width ratios can be used in other embodiments. For example, additional examples of suitable lengths include lengths of at least six inches, at least ten inches, at least twelve inches, at least eighteen inches, at least twenty-four inches, less than twenty-four inches, less than eighteen inches, less than twelve inches, in the range of six to eighteen inches, four to twelve inches, eight to twenty inches, twelve to twenty-four inches, sixteen to thirty inches, etc. Similarly, the toy 30 can include a body with one or more dimensions that are larger or smaller than the corresponding dimensions disclosed in the incorporated patents.

Body 32, 32', 32" can be constructed from a wide variety of water-compatible materials. An illustrative, non-exclusive example of a suitable material is low-durometer polyurethane. In addition to having the desired hydrodynamic properties, this material is also relatively soft, thereby providing a toy that is both safe and fun for use by children. Other examples of suitable materials include silicone rubber, natural and synthetic rubbers, ethylene propylene diene monomer rubber, polyvinylchloride (PVC), polyethylene, polyurethane, UV-curable or other polyesters, nylons, fiberglass, and various plastics and polymers, although any other suitable material for underwater children's toys can be used. In various embodiments, the body 32, 32', 32" can be rigid, semi-rigid, or collapsible. Body 32, 32', 32" can be formed via any suitable mechanism, including molding, blow molding, injection molding, transfer molding, casting, and the like.

Figure 4:
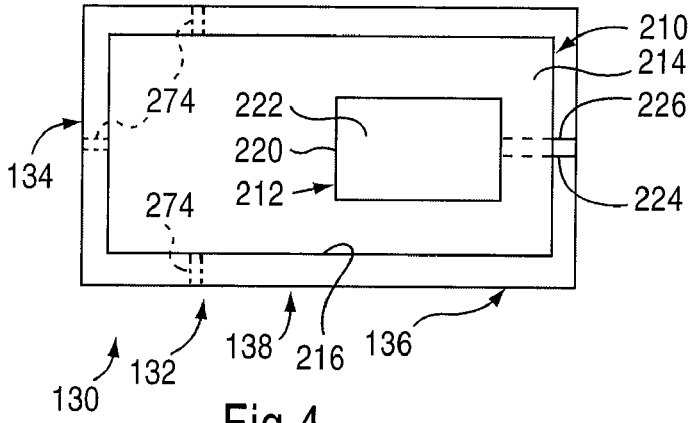
FIG. 4 is a schematic view of a hydrodynamic toy according to another embodiment of the invention.

As schematically illustrated in FIG. 1, toy 30 further includes an internal compartment 110 that houses at least a portion, if not all, of a hydraulic propulsion mechanism 112. Mechanism 112 is adapted to propel the toy 30 through a body of water through the selective emission of water (or other fluid or liquid) under pressure from the compartment of the toy 30. As schematically illustrated in FIG. 4, a toy 130 is shown including a body 132, which includes a hollow, or open, region 214 that defines an internal compartment 210, which is defined at least in part by an internal surface 216 of the internal compartment 210. In various embodiments, internal compartment 210 can have one of a variety of sizes relative to body 132. For example, body 132 can define a shell, or hull, in which the compartment extends between the nose and tail sections of the body. Alternatively, in some embodiments, the internal compartment can be smaller and thus does not extend completely between the nose and tail sections of the body, does not have substantially the same shape as the outer surface of the body, etc.

Mechanism 212 includes a reservoir 220 that is adapted to be charged with (i.e., at least partially filled) a volume of water through a fill port, or inlet port, 224 that is accessible from external the toy 130. The reservoir 220 defines at least one reservoir compartment, or internal volume 222 that is adapted to be charged with a volume of water under pressure to provide propulsion to the toy as the charge, or volume, of water is expelled from the reservoir through the subsequently discussed exit port(s) 226. As such, the reservoir 220, and toy 130, can be described as having charged and uncharged configurations, with the charged configuration corresponding to a configuration in which the reservoir contains sufficient water under pressure to propel the toy 130 through the body of water, and the uncharged configuration corresponding to when the reservoir 220 is empty or otherwise does not contain sufficient pressure and/or volume of water to propel the toy through the body of water when used as intended. The use of the term "water" is used herein as just one example of a fluid, liquid and/or gas that can be used to charge the reservoir of the propulsion mechanisms. In other words, the reservoir of the propulsion mechanism can be charged with one or more forms of a material such as a fluid, liquid or gas, and can be charged with one or more types of material such as a fluid form of water and a gas form of air.

The charge of water is at least temporarily stored in the reservoir 220 under pressure, with mechanism 212 further adapted to discharge the charge of water under pressure through one or more exit ports, or discharge orifices, 226 to propel the toy 130 through the body of water. Accordingly, fill port 224 and exit port 226 can be described as defining fluid conduits, or flow paths, between the compartment 222 of the reservoir 220 and a location exterior to the toy 130. In the illustrated example that is schematically illustrated in FIG. 4, the fill port 224 and exit port 226 are implemented as a single port through which a volume, or charge, of water is selectively introduced into the reservoir 220 and thereafter discharged under pressure therefrom. These ports can be implemented separately, with the fill port 224 defining a first fluid flow conduit through which the reservoir 220 is charged with the volume of water, and the exit port 226 defining at least a second fluid flow conduit through which the water is discharged from the reservoir 220 to propel the toy 130 through a body of water. Similarly, in FIG. 4 the fill/exit port 224, 226 is shown extending into the body 132 from the tail section 136 of the body 132, but this arrangement is not required in all embodiments. Accordingly, in some embodiments, at least one fill port and/or exit port may extend into the body 132 from a portion of the body 132 other than the tail section 136 of the body 132.

Figure 5:
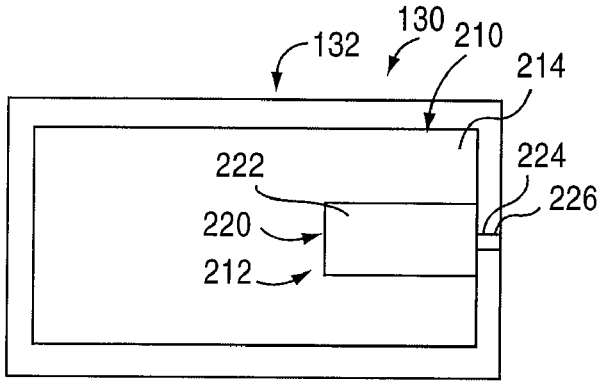
FIG. 5 is a schematic view of a hydrodynamic toy according to an embodiment of the invention with the reservoir shown in an uncharged configuration.
Figure 6:
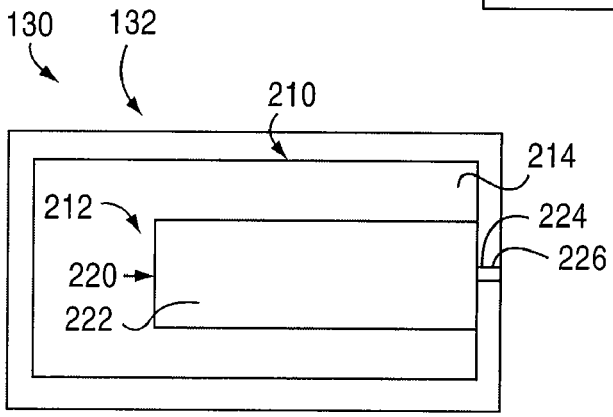
FIG. 6 is a schematic view of a hydrodynamic toy according to an embodiment of the invention with the reservoir shown in a charged configuration.
Figure 7:
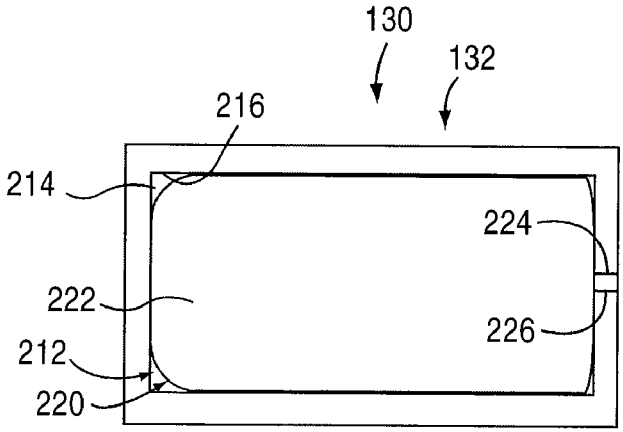
FIG. 7 is a schematic view of a hydrodynamic toy according to an embodiment of the invention with the reservoir shown in a charged configuration.

Reservoir 220 is adapted to expand, or increase, in volume as it is charged with a volume of water. As such, reservoir 220 can be described as being an expandable reservoir or a reservoir that has a first volume when not charged with a volume of water and a second (greater) volume when it is charged with a volume of water sufficient to propel the toy through a body of water. While not required, the reservoir 220 can be adapted to increase in volume between its uncharged and fully charged configurations by at least 50%, at least 100%, at least 200%, at least 300%, at least 500%, at least 1000%, at least 10,000%, at least 100,000% or more. Accordingly, the percentage of internal compartment 210 that is occupied by the reservoir 220, or at least the portion of the reservoir 220 that has been charged with a volume of water, will increase as the reservoir 220 is charged from its uncharged configuration to its charged configuration. Similarly, this percentage will decrease as the charge of water is expelled from the reservoir 220 through exit port(s) 226. The expandable nature of the reservoir 220 is schematically illustrated in FIGS. 5-7, with FIG. 5 illustrating a reservoir 220 in its uncharged configuration, and FIGS. 6 and 7 illustrating examples of a reservoir 220 in various charged configurations. In the example shown in FIG. 6, the water-containing portion of the reservoir 220 has expanded relative to its uncharged configuration. In FIG. 7, the reservoir 220 has expanded to engage the interior surface 216 of the internal compartment 210 of the toy's body 132. However, this is not required in all embodiments. By "expandable," it is meant that the region of the reservoir 220 that is adapted to house the charge of water is adapted to increase in size as the reservoir 220 is charged with water. For example, the volume of the internal compartment 210 (inclusive of the reservoir and other components contained therewithin) can be fixed, or otherwise adapted to remain essentially unchanged during use of the toy 130, such as when the body 132 is constructed from a rigid or generally rigid material. Alternatively, the volume of the internal compartment 210 (inclusive of the reservoir and other components contained therewithin) can increase as the reservoir 220 is charged with water, such as with the body 132 being partially or completely formed from an elastomeric or other stretchable or expandable material. In some embodiments, the body of the toy is the reservoir. For example, the body can be expandable or stretchable such that it can change shape, and defines an interior volume that can be charged with a volume of water.

Reservoir 220 can have any suitable construction that is adapted to receive and at least temporarily store a volume, or charge, of water under pressure. The reservoir 220 can be adapted to itself expel the charge of water through exit port(s) 226 to provide propulsion to the toy 130. Additionally or alternatively, propulsion mechanism 212 can include other components that exert forces to the reservoir 220 to urge the water to be expelled from the reservoir 220 through exit port(s) 226 to provide propulsion to the toy 130. Reservoir 220 can be constructed, for example, with rigid and/or elastomeric materials. When constructed with a rigid material, the reservoir 220 will typically define an interior volume that increases as the reservoir 220 is charged with water by sliding a moveable portion of the reservoir 220 against biasing forces that are provided by, for example, a spring, elastomeric member, or other biasing mechanism or member. An example of such a construction is a reservoir that includes at least one piston that is slid or otherwise displaced away from its position when the reservoir is uncharged by the water that is introduced into the reservoir, with the movement of the piston increasing the interior volume of the reservoir 220. The piston can be biased by a suitable biasing mechanism or biasing member to return the reservoir to an uncharged position and thereby urge the water to be expelled from the reservoir, such as through exit port(s) 226. This type of embodiment is described in more detail below with reference to FIGS. 8-10. Another example of a suitable construction is a bellows chamber with pleated or similar interconnected regions that are adapted to move cooperatively to increase the internal volume of the chamber as the chamber is charged with water, with the chamber being biased to return toward its uncharged configuration (and thereby its smaller volume) by a suitable biasing mechanism.

Figure 8:
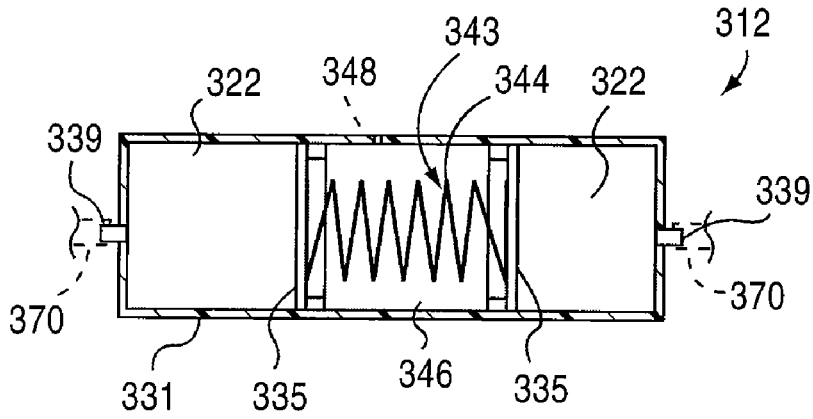
FIG. 8 is a side elevation view shown partially in cross-section of a portion of a propulsion mechanism for use in a hydrodynamic toy according to an embodiment of the invention.
Figure 9:
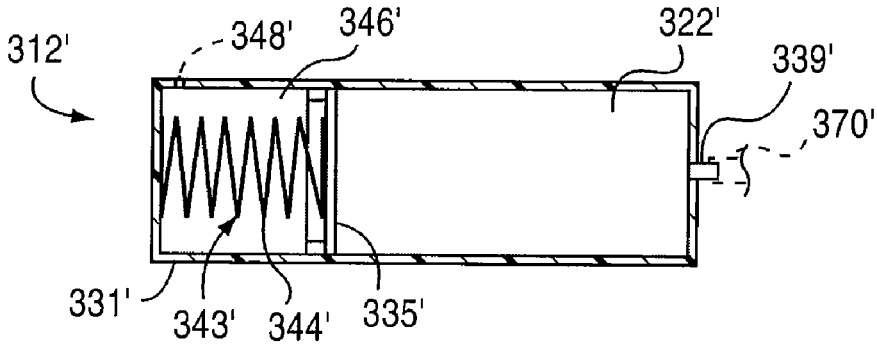
FIG. 9 is a side elevation view shown partially in cross-section of another example of a portion of a propulsion mechanism for use in a hydrodynamic toy according to an embodiment of the invention.
Figure 10:
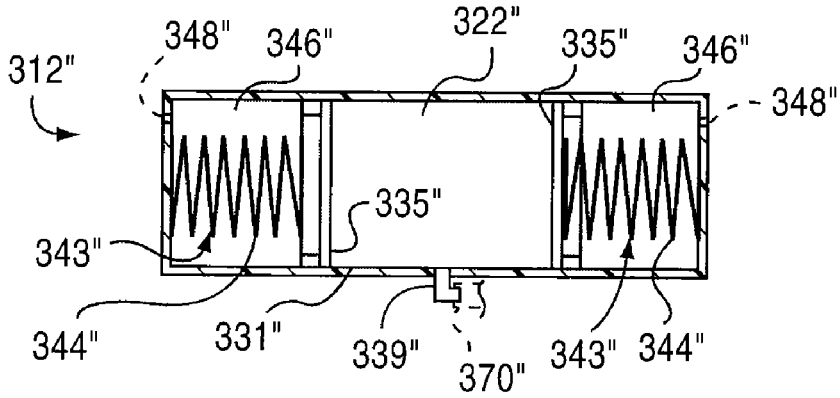
FIG. 10 is a side elevation view shown partially in cross-section of another example of a portion of a propulsion mechanism for use in a hydrodynamic toy according to an embodiment of the invention.

Illustrative, non-exclusive examples of propulsion mechanisms that include at least one piston are shown in FIGS. 8-10 and are generally indicated at 312. In the example shown in FIG. 8, the propulsion mechanism 312 includes a housing or body 331 within which at least one piston 335 is housed and positioned for slidable movement. In the illustrated example of FIG. 8, the propulsion mechanism 312 includes a pair of pistons 335. A pair of reservoir compartments 322 are each defined in part by the housing 331 and the pistons 335. Housing 331 can be positioned within an internal compartment of a body (e.g., body 32, 32', 32", 132) of a toy (e.g., toy 30, 30', 30", 130), and the body can form at least a portion of the housing in some embodiments. As an illustrative, non-exclusive example, an internal surface (e.g., surface 216 in FIG. 11) of the body's internal compartment can form a portion of the housing 331. In some embodiments, a piston-containing propulsion mechanism 312 for toys 30 (30', 30", 130) can include only a single piston, two pistons, or more than two pistons. Pistons 335 can, in some embodiments, form a seal with internal surfaces 336 of the housing 331 against which they are in contact during the slidable path along which the piston 335 travels between the charged and uncharged configuration of the propulsion system. Although a fluid-tight seal is not required in all embodiments, leakage of water from the reservoir compartment 322 reduces the volume of water available to be used to generate propulsion for the toy.

Each reservoir compartment 322 is adapted to be charged with a volume of water that can be selectively expelled from the propulsion system to generate propulsion for the toy. Also shown are ports 338 in fluid communication with the compartments 322 and through which the compartments 322 are selectively charged with water and from which the water is expelled to generate propulsion for the toy. In some embodiments, separate input and exit ports can be used. Also, in some embodiments, a common port can be used for both charging and discharging the compartments 322. Similarly, the ports can be in fluid communication with each other, such as via one or more fluid conduits 370. Conduit(s) 370 can be configured to establish fluid communication between ports 339 and the fill and exit ports of the toy. Also, at least one of the ports 339 also can form at least a portion of ports defined by the body of the toy, e.g. ports 224 and/or 226 shown in FIGS. 4-7.

Propulsion mechanism 312 includes a biasing mechanism or member 343 that is adapted to bias the pistons 335 toward their uncharged configuration. Expressed in slightly different terms, the biasing mechanism 343 is adapted to bias the pistons 335 to urge water within compartments 322 out of the reservoir compartments 322. When the reservoir compartments 322 are charged, the pistons 335 are moved against the bias of mechanism 343. Accordingly, the reservoir(s) of piston-containing propulsion mechanisms can be described as increasing in length (or increasing in their dimension along the long axis of the piston's path) as the piston is urged from its position when the propulsion mechanism is in its uncharged configuration to the piston's position when the mechanism is in its charged configuration. In the illustrated example, biasing mechanism 343 takes the form of a spring, or spring member, 344, but any suitable type and number of biasing mechanism can be used. Similarly, each piston can be adapted to be biased by a separate biasing mechanism, or component thereof. Although not required, at least a portion of the biasing mechanism, or biasing member(s), can be secured in a defined position or orientation relative to the housing 331. In the illustrated example, propulsion mechanism 312 can also be described as defining a region 346 within housing 331 that is not occupied by the pressurized water used to generate propulsion for the toy. This region can include one or more vents 348 to permit water from within the internal compartment of the toy to fill and/or be removed from the region, i.e., biasing region 346, of the propulsion system. Region 346 may also be described as a portion of the internal compartment of the body (e.g., compartment 214 in FIGS. 4-7) that does not form a portion of a reservoir compartment 322.

FIG. 9 provides an example of a piston-containing propulsion mechanism that includes a single piston 335'. FIG. 10 provides another example of a piston-containing propulsion mechanism that includes a pair of pistons 335", including a separate spring member 344" (or other biasing mechanism) associated with each piston 335". Similarly, while the illustrated examples of biasing mechanisms include compression springs, in some embodiments, springs or other biasing mechanisms can be used that are adapted to be expanded (or placed in tension) when the propulsion mechanism is in its charged configuration. In such a configuration, the springs or other biasing mechanism can be positioned within a region 346, 346', 346" or otherwise located in a suitable position to bias the piston to provide the propulsive forces described herein.

Another example of a suitable construction for a reservoir compartment is for the reservoir to be formed from an elastomeric material that stretches as the reservoir is charged with water to increase the volume of the reservoir. In such an embodiment, the reservoir can be described as being or including an elastomeric bladder. The elastomeric nature of the reservoir provides a biasing force, or mechanism, that biases the reservoir to return to its uncharged configuration and therefore urges the water contained in the reservoir to be expelled from the reservoir through exit port(s). Illustrative, non-exclusive examples of suitable materials include latex and neoprene rubbers, other synthetic and natural rubbers, ethylene propylene diene monomer rubber, etc. As discussed, the reservoir itself can exert sufficient force upon the charge of water to expel the water from the toy with sufficient force to generate sufficient propulsion of the toy through the body of water. In some embodiments, the propulsion mechanism can include a biasing mechanism in addition to an elastomeric reservoir to increase the force exerted upon the charge of water. An elastomeric bladder can be formed from other types of processes such as, for example, a molding process or with an extrusion process.

Illustrative examples of propulsion mechanisms that include an elastomeric (flexible) reservoir, or bladder, are shown in FIGS. 11-15, with these bladder-containing propulsion mechanisms being generally indicated at 412, 412', 412". In FIGS. 11-15, reservoirs 420, 420', 420" are shown positioned within an internal compartment 410, 410', 410" of a body 432, 432', 432" of a toy 430, 430', 430" respectively. Alternatively, the bladder or reservoir can be contained within a separate housing within internal compartment 410, 410', 410", but this construction is not required.

Figure 11:
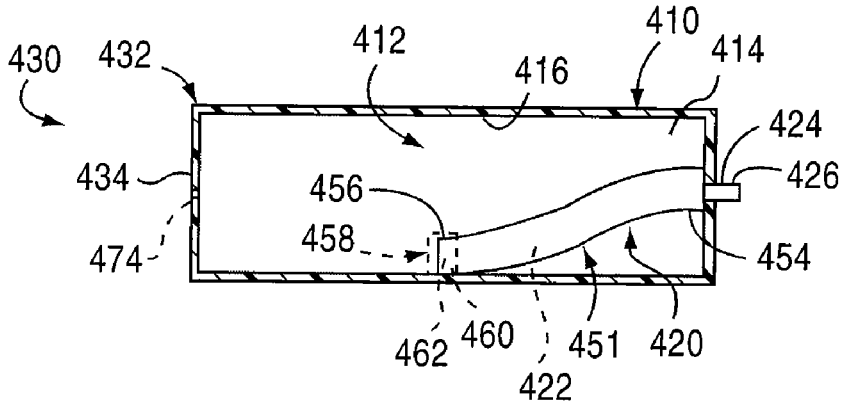
FIG. 11 is a side elevation view of another example of a portion of a propulsion mechanism for use in a hydrodynamic toy according to an embodiment of the invention with the reservoir shown in an uncharged configuration.

In FIG. 11, an example of an elastomeric reservoir 420 in an uncharged configuration is shown. As shown, the reservoir 420 includes a length of elastomeric material 451 that forms at least a substantial portion, if not all, of the reservoir 420. As such, reservoirs that use an elastomeric bladder to emit water under pressure from an exit port of the toy can still include other rigid or otherwise non-elastomeric components. The reservoir 420 includes generally opposed, or distally spaced, first and second end regions 454 and 456. In the illustrated embodiment, the first end region 254 is coupled, directly or indirectly, to the fill port 424 and exit port 426 of the toy 430, while the second end region extends within the internal compartment 410 of the toy. As such, the illustrated example of an elastomeric reservoir provides a free end region that can move (i.e., toward and away from the tail and nose regions, toward and away from the sidewalls of the compartment, etc.) within the internal compartment of the toy, such as when the bladder is charged and discharged, respectively, with water.

Second end region 456 can be sealed so that water introduced into the reservoir 420 is retained in the reservoir 420 until emitted through exit port 426. Elastomeric reservoir 420 can be formed through a molding or other process in which the reservoir 420 is formed with only the opening(s) corresponding to the first end region's fluid connection with the fill and exit ports 424, 426. In some embodiments, it may be desirable to form the elastomeric reservoir from a tubular material, such as elastomeric surgical tubing or elastomeric tubing used in diving applications. When the length of elastomeric material includes opposed openings associated with the first and second end regions, the opening associated with (i.e., formed in) the second end region can be sealed or otherwise plugged or capped to restrict and prevent water from flowing therethrough. For example, the propulsion mechanism can include a sealing member 458 that is adapted to close the opening in the second end region. Illustrative examples of a sealing member 458 include mechanical sealing members 460 and chemical sealing members 462. Illustrative examples of mechanical sealing members 460 include plugs that are inserted into the second end region, knots tied into the second end region of the elastomeric material, wires, ties, or similar bands that are compressed around the second end region to seal the second end region, and clips or clamps that compress the material together to seal the second end region. Illustrative examples of chemical sealing members 462 include seals formed by heating, welding, (at least partially) dissolving portions of the reservoir and/or applying an adhesive, epoxy, or similar curable or reactive material to the second end region to seal the second end region.

Figure 12:
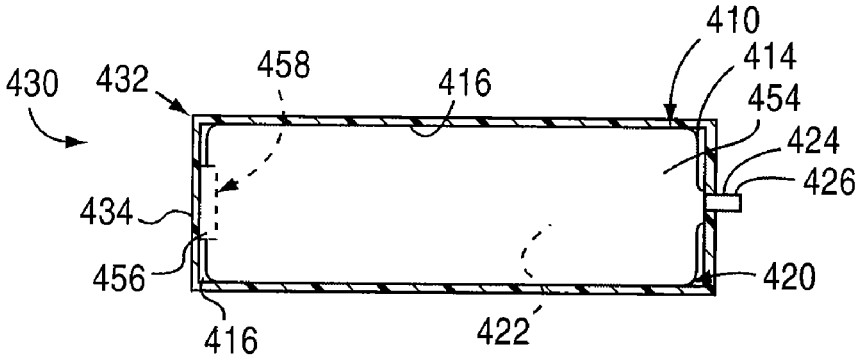
FIG. 12 is a side elevation view showing the propulsion mechanism of FIG. 11 with the reservoir in a charged configuration.

When the elastomeric reservoir 420 shown in FIG. 11 is charged with a volume of water, the reservoir 420 will increase in size, with the unfixed nature of the second end region facilitating the reservoir 420 to increase in length and width as the reservoir 420 is charged with water, such as shown in FIG. 12. In the illustrated example shown in FIG. 12, reservoir 420 has expanded to substantially fill the internal compartment 410. Alternatively, in some embodiments, the reservoir and/or body can be sized so that even a fully charged reservoir does not fill the internal compartment of the body. For example, the reservoir may not expand sufficiently in length and/or width to engage the corresponding internal surfaces of the body's internal compartment.

In some embodiments, the reservoir is sized relative to the housing or internal compartment in which it is positioned and/or otherwise configured or constructed to only, or primarily, expand in length or width. For example, in the embodiment illustrated in FIGS. 13 and 14, a second end region 456' is shown retained in a selected, or fixed, position relative to the toy's body 432'. In this illustrated example, a fastening mechanism 466 secures the second end region 456' to the body 432'. In some embodiments, mechanism 466 can be adapted to secure the second end region 456' to a support (not shown) that extends within the body's internal compartment 410'. When in an uncharged configuration, such as illustrated in FIG. 13, some stretching or expansive forces can still be imparted to the reservoir 420' due to its first and second end regions being positioned, or at least restricted from being drawn together, within the internal compartment 410' of the toy's body 432'.

Figure 13:
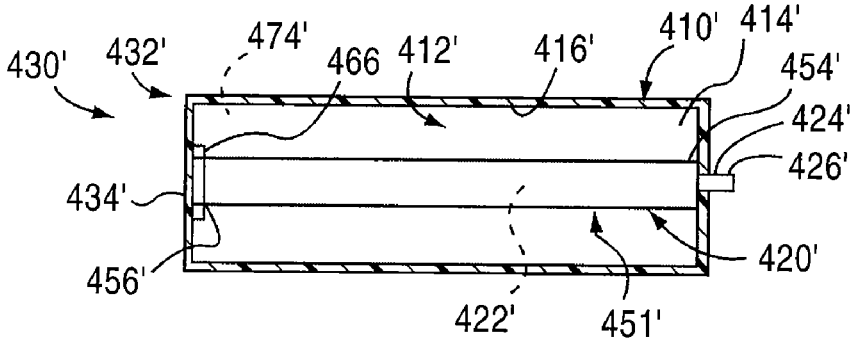
FIG. 13 is a side elevation view of another example of a portion of a propulsion mechanism for use in a hydrodynamic toy according to an embodiment of the invention with the reservoir shown in an uncharged configuration.
Figure 14:
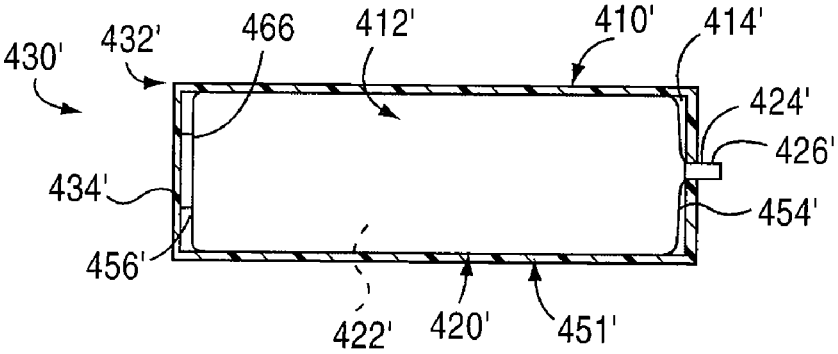
FIG. 14 is a side elevation view showing the propulsion mechanism of FIG. 13 with the reservoir in a charged configuration.
Figure 15:
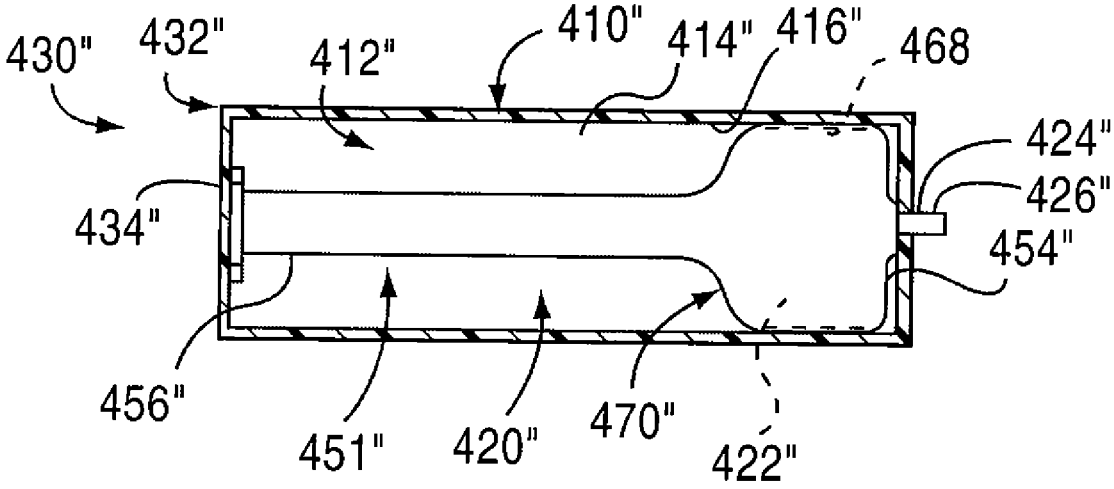
FIG. 15 is a side elevation view of another example of a portion of a propulsion mechanism for use in a hydrodynamic toy according to an embodiment of the invention.

FIG. 14 shows the reservoir 420' of FIG. 13 in a charged configuration. As illustrated, the reservoir 420' expands primarily, if not exclusively, in a radial direction, with the width of the reservoir 420' increasing, but the length remaining the same or nearly the same. A potential benefit of such a construction is that the reservoir fully expands within the limits imposed by the body or other internal structure of the toy. Described in slightly different terms, when the elastomeric reservoir is charged with water, it may tend to initially expand in a localized region of the reservoir and thereafter expand in other regions of the reservoir, similar to how an elongate balloon is often inflated. This initial expansion may restrict the full charging of the reservoir and/or result in crimping of the reservoir should the reservoir extend and be frictionally or otherwise constrained against further movement by its engagement with the inner surface 416' of the toy's internal compartment 410'. Accordingly, in some embodiments, it may be desirable to form the reservoir and/or structures that are engaged by the reservoir when in its charged configuration from a friction-reducing material and/or to coat or otherwise apply a friction-reducing coating thereto, as schematically illustrated in FIG. 15 at 468. Configuring the fill port (e.g., 424, 424', 424") to deliver the charge of water to or proximate the second end region 456 (456', 456") of the reservoir may also promote complete filling of the reservoir.

In some embodiments, the elastomeric material can be formed or otherwise treated to define the region of the reservoir in which the expansion first occurs when the reservoir is of a type that is predisposed to expand initially in a localized subset of the length of material. For example, when a portion of the length of material is thinner than other regions, it is more likely to exhibit the initial expansion as the reservoir is charged with water. Therefore, by initially forming the reservoir with a region of reduced thickness, a region of initial expansion, can be predefined. This type of embodiment is schematically illustrated in FIG. 15 at 470. As illustrated, region 470 is proximate the fill port 424" of the toy's propulsion mechanism 412", but in other embodiments, such a region can be located anywhere along the length of the elastomeric reservoir. Similarly, a region of the length of elastomeric material can be treated after it is formed to add or remove material therefrom (and/or to make the region thicker or thinner or otherwise mechanically stronger or weaker than other regions of the material). Examples of suitable treatments include chemical treatments, such as applying coatings, solvents, additional layers of curable material, etc., and/or mechanical treatments, such as grinding, cutting, deforming, abrading, or reinforcing with additional physical layers or supports.

Turning now to some general features of a toy (e.g., toy 30, 130, 230, 430), referred to as toy 30 for simplicity. Toy 30 can be constructed to be (generally) neutrally buoyant when positioned, or suspended, in water. This neutral, or near-neutral, buoyancy may facilitate the toy traveling relatively long distances underwater without surfacing or striking the bottom of the body of water. For example, toy 30 can have a specific gravity in the range of approximately 0.7 and approximately 1.3, a specific gravity in the range of approximately 0.8 and approximately 1.2, a specific gravity in the range of approximately 0.9 and approximately 1.1, a specific gravity greater than 1, a specific gravity less than 1, etc. In some embodiments, the toy 30 can have a specific gravity outside of this range. For example, toy 30 can include one or more fillable internal cavities and/or may be configured to receive weights or buoyant materials to allow a user to adjust the buoyancy of the toy. Having a neutral, or near neutral, buoyancy allows the toy to remain at a user-selected elevation, or depth, within the body of water. As such, the toy 30 can be adapted to neither sink to the bottom nor rise to the top of the body of water within which it is used. Thus, the toy can be launched over sizable distances underwater while maintaining the trajectory imparted by the user. In other embodiments, the toy can be configured to be positively or negatively buoyant relative to the body of water in which the toy is used. Although not required, the toy can have centers of gravity and/or buoyancy forward of its center of pressure to increase the glide path, and potentially maintain stability, of the toy in the body of water. This can also potentially increase the horizontal distance the toy travels through the body of water.

In some embodiments, it may be desirable for toy to be constructed or adjusted to be positively buoyant to ensure the toy floats to the surface of the body of water for easy retrieval. In this case, its center of buoyancy can be forward of its center of pressure and/or center of gravity to maximize the distance of underwater travel before surfacing. As a further alternative, toy may be constructed or adjusted to be negatively buoyant to cause the toy to sink to the bottom of the body of water. For example, a positively buoyant version of toy may have a specific gravity in the range of approximately 0.95 and 0.7 or even 0.5, although the more positively buoyant the toy, the less horizontal distance it will travel when launched from underwater. On the other hand, a negatively buoyant version of toy may have a specific gravity in the range of approximately 1.05 to 1.5 or 2.0 or higher. In embodiments where toy is designed to be negatively buoyant when propelled through the body of water by propulsion mechanism (e.g., mechanism, 312, 412), the center of gravity may be (but is not required to be) forward (i.e., closer to nose region), if the toy's center of buoyancy, and the centers of gravity and buoyancy may be forward of the toy's center of pressure.

While not required in all embodiments, the toy can be constructed to have the same, or nearly the same (such as +/−5%, +/−10%, or +/−20%) buoyancy when in both its charged and its uncharged configurations. In such a configuration, the toy can be adapted to draw additional water into its internal compartment as water is expelled through exit port, thereby maintaining the buoyancy of the toy. For example, an embodiment of the toy can include one or more vents or equalization ports (see e.g., FIGS. 13 and 14) that extend through the body of the toy to interconnect fluidly the internal compartment and the exterior of the toy. In the illustrated example shown in FIG. 4, several vents 274 are schematically illustrated and include at least one vent 274 in nose section 134 and at least one vent 274 in mid-section 138. The size, number and position of the vents may vary, including configurations in which the toy does not include a vent. When present, vents may also be used to remove entrapped or entrained air from internal compartment, such as air trapped between the internal surface of the internal compartment and reservoir.

The toy can (but is not required to) additionally or alternatively be adapted to maintain its center of buoyancy and/or center of gravity during its underwater travel that is propelled by the propulsion mechanism and/or between its charged and uncharged configurations. The toy can (but is not required to) have a center of buoyancy and/or gravity during its underwater travel (and optionally when thereafter uncharged by still submerged) that is within +/−5%, +/−10%, +/−15%, +/−20%, +/−25%, +/−50%, or +/−75% (measured along the long axis A of the toy toward the nose and tail sections) of its center of buoyancy and/or gravity in its fully charged configuration.

As discussed previously, a fill port can be adapted to be removably coupled to a water supply or source of fluid to establish a fluid conduit to charge the reservoir (or reservoir compartment) with a volume of water. The water supply can be adapted to deliver water under pressure to the reservoir via fill port. An illustrative example of a suitable water supply is a household (or other domestic) water supply. Another illustrative example is a water supply for a pool or sprinkler system. Domestic water supplies typically are adapted to provide water at pressures up to 60 psi (for households) or 75 psi (for dedicated sprinkler systems). Other pressures can be used, such as water supplies that are adapted to deliver water at pressures in the range if 10-100 psi, 10-40 psi, 15-30 psi, 30-60 psi, 30-90 psi, 60-90 psi, 40-60 psi, 45-75 psi, and the like. Water may be treated as an incompressible fluid at these pressures. Another illustrative example of a suitable water supply is the body of water in which the toy will be used.

The rate and/or duration that the toy travels through the body of water will vary according to a variety of factors, including but not limited to, the hydrodynamic properties of the toy, the pressure of water within the reservoir, steering and/or righting moments imparted to the toy by its trajectory stabilizing structure, the orientation of the toy when the propulsion system is actuated, any initial velocity imparted to the toy (such as by a user's hand or other launch/release mechanism adapted to impart an initial velocity to the toy), the rate at which the water is discharged through the exit port, the size of the exit port, the volume of water in the reservoir, etc.

The toy, and more specifically, a fill port, such as fill or inlet port 224, can be directly coupled to the water supply, or alternatively may be connected to the water supply via a hose or other suitable fluid conduit. For example, the fill port of the toy may be adapted to be fluidly connected to a hose that is connected to a hose bib adjacent the body of water. Additional examples include hoses that are connected to water returns associated with a pool's pump and/or with pressurized water jets that are adapted to deliver and/or circulate water within the pool or other body of water in which the toy will be used. Another example of a suitable water supply is a manual or powered pump that is adapted to deliver water under pressure to the fill port. For example, a manual pump may be a piston-driven mechanism that a user operates to draw water from the pool or other body of water in which toy 30 will be used, and to deliver the water under pressure to the fill port of the toy. In some embodiments, a manual pump is incorporated into the toy, as illustrated in FIGS. 42-44.

Figure 16:
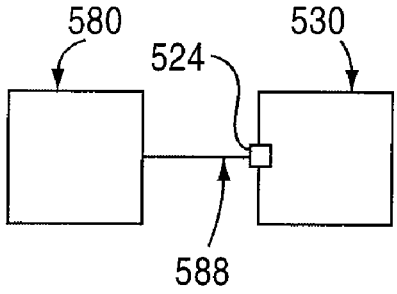
FIG. 16 is a schematic view of a toy according to an embodiment of the invention and a water source for charging the reservoir of the toy's propulsion mechanism.
Figure 17:
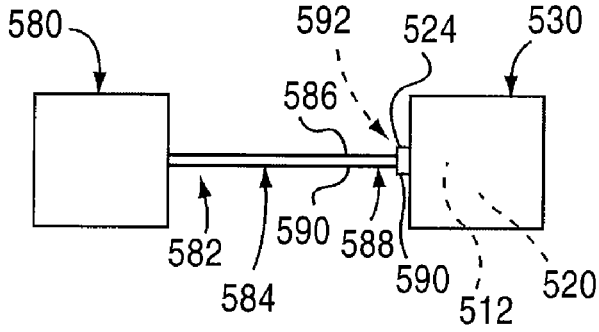
FIG. 17 is another schematic view of a toy according to an embodiment of the invention and a water source for charging the reservoir of the toy's propulsion mechanism.

A toy can be directly coupled to the water supply, or it can be fluidly connected to the water supply by a hose or other conduit. This is schematically illustrated in FIGS. 16-17. In FIG. 16, the water supply, or water source, is generally indicated at 580 and is schematically illustrated being in fluid communication with the fill port 524 of the toy's propulsion mechanism. As discussed, fill port 524 is adapted to be releasably coupled to the water supply to charge the toy's reservoir with water that generates propulsive forces for the toy when the water is expelled from the reservoir through an exit port (not shown in FIG. 16). In FIG. 17, the water supply 580 is shown being in fluid communication with, or fluidly connected to, input port 524 of toy 530 by a hose assembly 582 that includes one or more lengths of fluidly interconnected tubing 584.

For the purpose of brevity, the following discussion will focus upon a fluid interconnection between fill port 524 and a discharge end 586 of hose assembly 582. However, it is to be understood that the components discussed herein can also be used to interconnect a water supply with the toy's fill port without using a hose assembly and/or to interconnect fluidly the water supply to the fill port with a fluid conduit other than hose assembly 582. Also, although only one hose assembly is illustrated and described, a splitter (not shown) can optionally be used to couple multiple toys to a single water supply. For example, a splitter can include multiple hose assemblies so that one end of the splitter is coupled to a single water supply (e.g., a hose) and the other ends of the multiple hose assemblies can each be coupled to a fill port of a separate toy.

Fill port 524 and the discharge end 586 of hose assembly 582 (and/or the discharge end of water supply 580 and/or another suitable fluid conduit for interconnecting the water supply with the fill port of the toy) can be adapted to be releasably coupled together to permit effective charging of the toy's propulsion mechanism 512. As such, either or both of fill port 524 and discharge end 586 may include, or be connected to, a coupling structure 588 that is adapted to provide a fluid interconnection between these components to enable charging of the propulsion mechanism. For example, either or both of port 524 and end 586 can include a fitting 590 that is sized and/or constructed to interconnect releasably with a complimentary configured fitting 590 associated with the other one of port 524 and end 586 and/or the existing construction of port 524 and end 586. By this it is meant that port 524 and/or end 586 can have a suitable fitting 590 releasably attached thereto or may be formed to include the fitting. By "releasably," it is meant that the corresponding elements are designed to be repeatedly connected and disconnected without destroying the elements or any interconnecting structure. The fittings can be adapted to remain coupled together until a user urges the fittings apart from each other, until sufficient force is generated within the reservoir to urge the fittings apart from each other, and/or until a mechanical release is actuated by a user. A spring, or other biasing or launch mechanism, can provide an initial acceleration force to the toy during launch, i.e., when released for underwater travel powered by propulsion mechanism 512. Such a spring or other mechanism can be incorporated into one or both of the fittings or otherwise positioned to impart this initial thrust to the toy.

An illustrative, non-exclusive example of a suitable configuration for coupling structure 588 includes quick-connect fittings that are adapted to be retained together until a manual release is actuated by a user. Examples of suitable quick connect fittings are manufactured by Colder Products Company, and include the fittings disclosed in U.S. Pat. No. 5,052,725, the complete disclosure of which is hereby incorporated by reference for all purposes. Other quick-connect fittings include a longitudinally slidable release element, such as is often employed with quick-connect assemblies for gas conduits. Another example is a frictional fitting in which one of the corresponding components is inserted at least partially into the other component to establish a fluid interconnection, with the components being frictionally retained together. Further examples include threaded interconnections and compression seals or other frictional interconnections.

Additionally, and/or alternatively, either of port 524 and/or end 586 can include or be releasably connected to a valve assembly that is adapted to restrict selectively the flow of water therethrough when the valve assembly is in an off position. The valve assembly can be an automatic valve assembly, such as a valve assembly that is adapted to prevent water from flowing therethrough when corresponding components of the coupling structure are not interconnected together. As another example, the valve assembly can be a manual valve assembly in which a user selectively configures the valve assembly between "on" (water may flow through the valve assembly) and "off" (water is restricted from flowing through the valve assembly) configurations. Manually actuated valve assemblies therefore include a user-manipulable element that configures the valve assembly between its on and off configurations responsive to inputs from a user. While not required, an automatic valve assembly, when used, will most likely be associated with end 586, while a manually actuated valve assembly can be associated with either end 586 or port 524. For example, including a manual on/off valve with fill port 524 enables a user to charge the toy's propulsion mechanism and disconnect the toy from the water source without necessarily initiating the emission of water under pressure from the toy's propulsion mechanism. Instead, if the manual valve assembly is in an off configuration, the user can position the toy in a desired orientation and location in a body of water and thereafter initiate the self-propulsion of the toy by configuring the manual valve assembly to an on configuration. When the toy includes separate fill and exit ports, the fill port can include an automatic one-way or check valve that prevents water from being expelled from the reservoir through the fill port.

Figure 18:
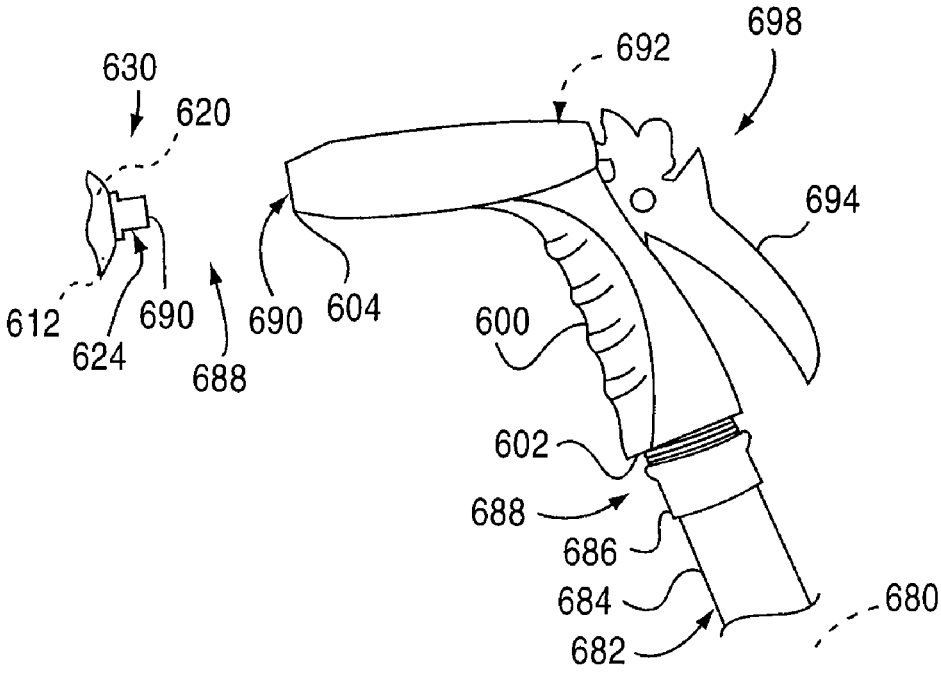
FIG. 18 is another schematic view of a portion of a toy according to an embodiment of the invention and a water source for charging the reservoir of the toy's propulsion mechanism.
Figure 19:
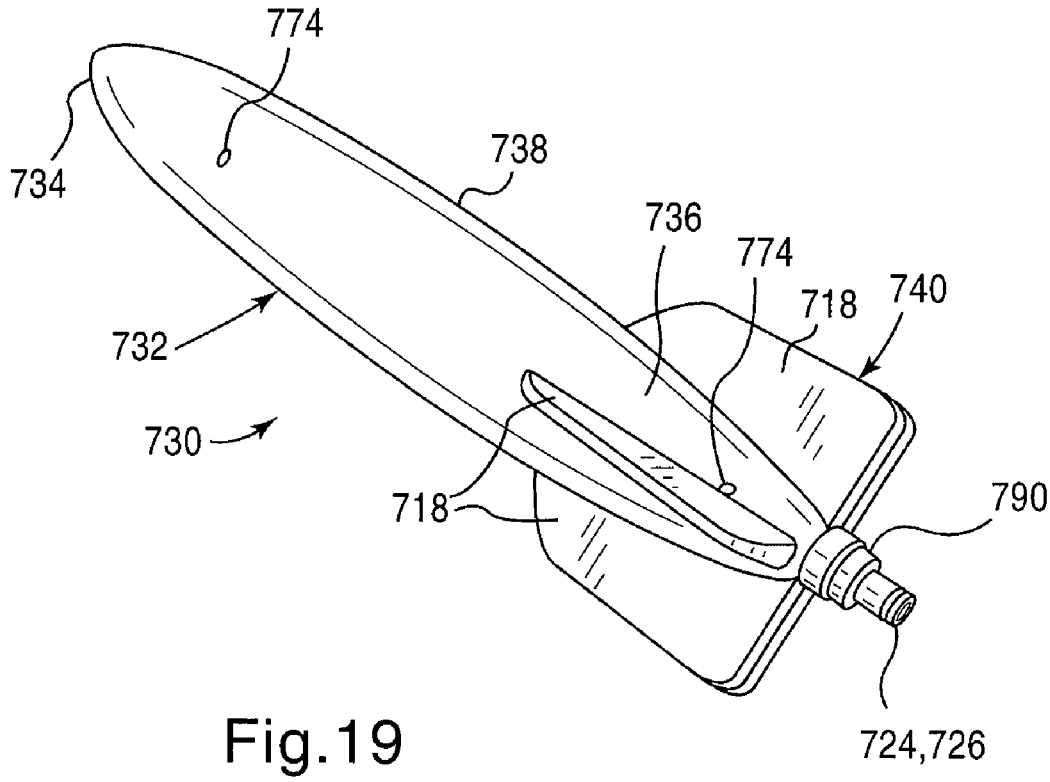
FIG. 19 is a rear perspective view of another example of a hydrodynamic toy according to an embodiment of the invention.
Figure 20:
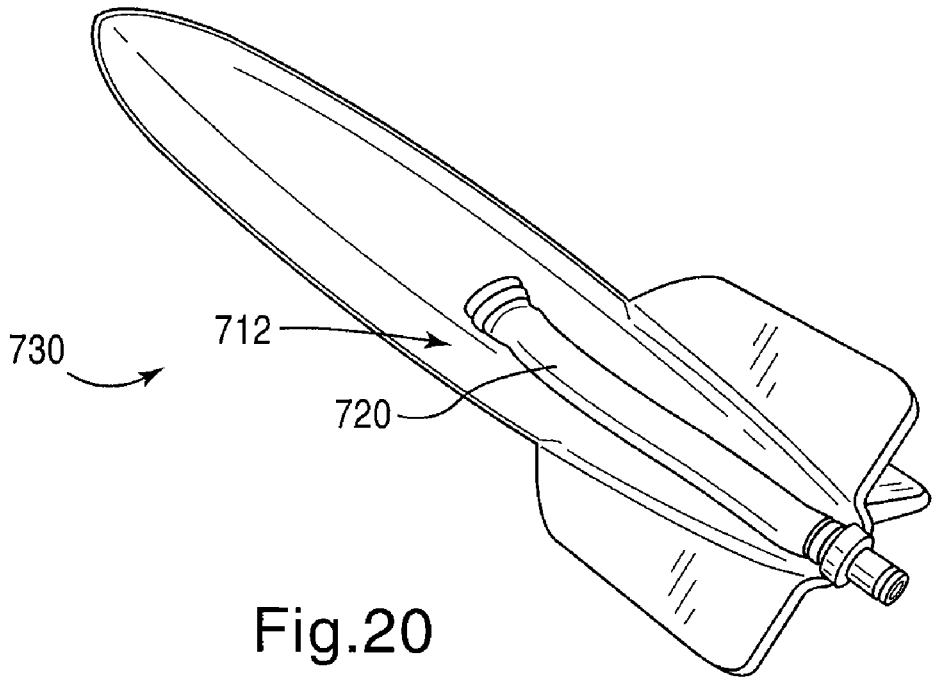
FIG. 20 is a partial cross-sectional view of the toy of FIG. 19.

In FIG. 18, a hose assembly 682 having a rubber hose portion 684 and a discharge end 686 is shown coupled to a charging member 698. Similar to a spray nozzle for a garden hose, the charging member 698 includes a handgrip 600 that is configured to be held in a user's hand, and a releasable coupling structure 688 that is adapted to interconnect fluidly the distal or discharge end 686 of hose assembly 682 with a hose fitting 602 on the charging member 698. The charging member also includes a releasable coupling structure 688 that is adapted to interconnect fluidly the fill port 624 of the toy 630 with a fill port fitting 604 on the charging member 698. As illustrated, the charging member 698 also includes a manual valve assembly 692 with a manual element 694 that is adapted to be squeezed in a user's hand to move the valve assembly 692 between an on and off configuration.

In use, any of the toys described herein can be charged with a volume of water and oriented in a selected launch orientation, or position, such as by aligning a longitudinal central axis generally along the trajectory selected by the user, with the nose section positioned forward of tail section. The toy is released by the user and the propulsion mechanism urges the toy along the selected underwater trajectory by expelling water through one or more exit ports. The toy can be adapted to travel a distance, for example, of at least 10 feet, and/or at least 20, 30, 50 or more feet under its own (i.e., self-generated) propulsion through the body of water when the reservoir (e.g., reservoir 220) is fully charged and the toy is released by the user in the body of water. The release of the toy for underwater travel can include one or more of disconnecting the toy from the water supply prior to positioning the toy for underwater travel, releasing a quick-release or other mechanical fitting that interconnects the toy with a hose, and configuring an on/off valve associated with the exit port to an on (or fluid-emitting) configuration.

While toy (e.g., toy 30) is described herein as a being a toy that is adapted to be self-propelled through a body of water, the toy can alternatively be hand-launched or otherwise manually launched by a user through the body of water. For example, toy 30 can be sized for grasping by a user's hand, such as in the notch formed by the user's thumb and index finger, and manually propelled through the body of water. Similarly, while described as being an underwater toy that travels along an underwater trajectory, the path of the toy 30 can include an initial aerial portion, such as when the toy 30 is launched into a body of water.

FIGS. 19-24 provide a non-schematic example of a hydrodynamic underwater toy according to an embodiment of the invention. In the illustrated example, the toy 730 includes a body 732 with a trajectory-stabilizing structure 740 in the form of radial fins 718. Alternatively, the toy can be implemented with any of the trajectory-stabilizing structures described, illustrated and/or incorporated herein (or no trajectory-stabilizing structure). Similarly, the illustrated embodiment of the toy's body and propulsion mechanism are intended for the purpose of illustration rather than limitation, in that they show but one of the many possible embodiments. For the purpose of brevity, these various options for the particular embodiments will neither be repeated in connection with the discussion of FIGS. 19-24, nor with the discussion of the illustrative embodiments shown in subsequently discussed FIGS. 25-37 and FIGS. 42-44. However, it is to be understood that the particular examples of selected components or elements illustrated in these figures can be implemented with other components illustrated, described, and/or incorporated herein.

The example of a toy 730 illustrated in FIGS. 19-24 includes a coupling structure, or connection assembly, 788 (see FIGS. 21 and 22) in the form of a quick-connect connect assembly that includes fittings or coupling members 790, 790', with the fitting 790 that extends from the toy 730 forming a portion of the fill port 724 (and exit port 726) of the toy 730 and being adapted to be received into the fitting 790' that is connected to the distal or discharge end 786 of hose assembly 782. By pressing a user-manipulable release in the form of a lever or button 713, the fittings 790 are able to be separated from each other. Otherwise, the fittings 790 are biased to remain interconnected. The body 732 of toy 730 illustrates several examples of vents 774 that are adapted to permit entrapped air to be removed from the body's internal compartment (not shown) and/or to permit water to be drawn into the body's internal compartment as the reservoir 720 is discharged and thereby reduced in size.

Figure 21:
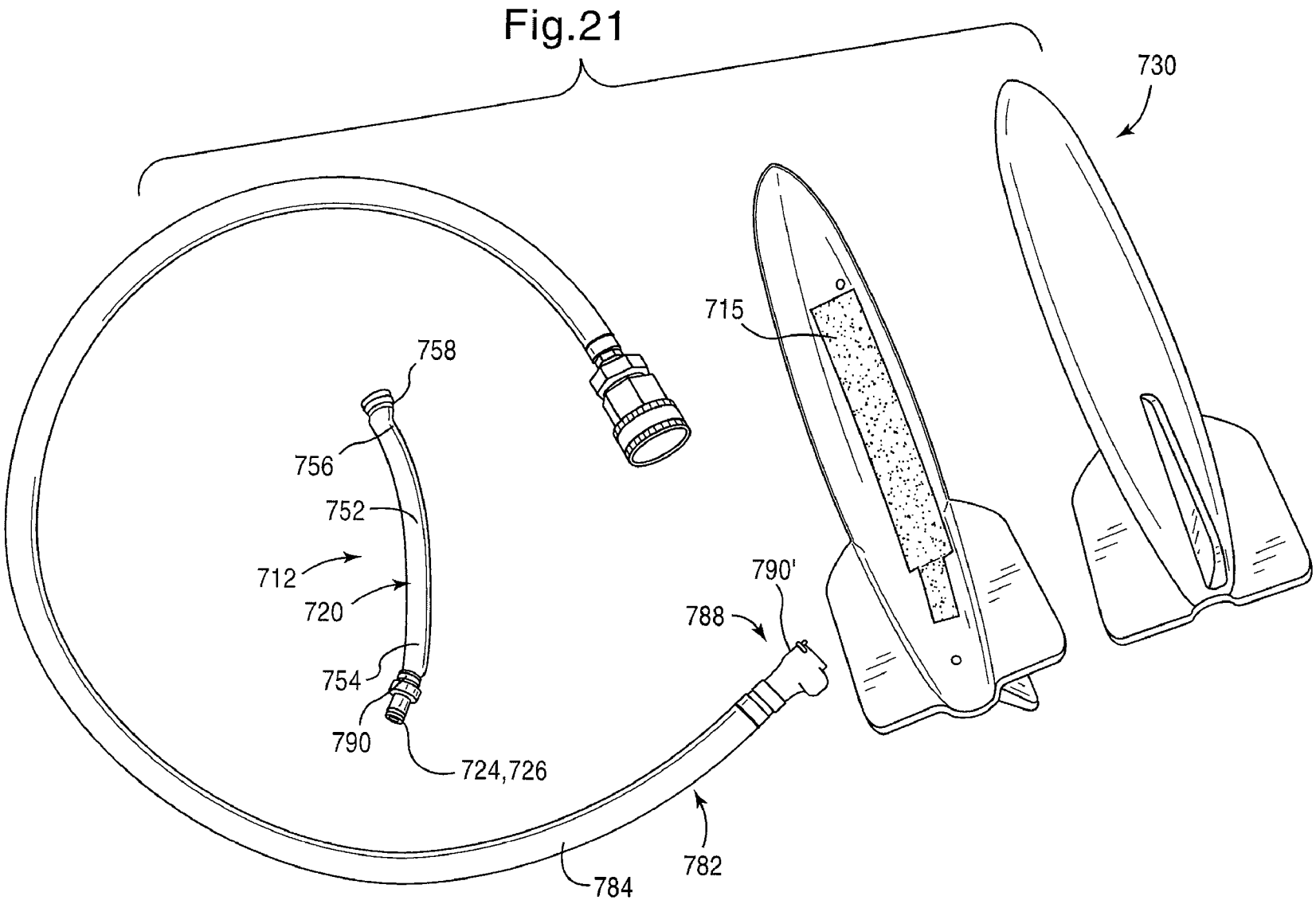
FIG. 21 is an exploded plan view of the toy of FIG. 19 and a portion of a hose assembly for charging the propulsion mechanism of the toy.
Figure 22:
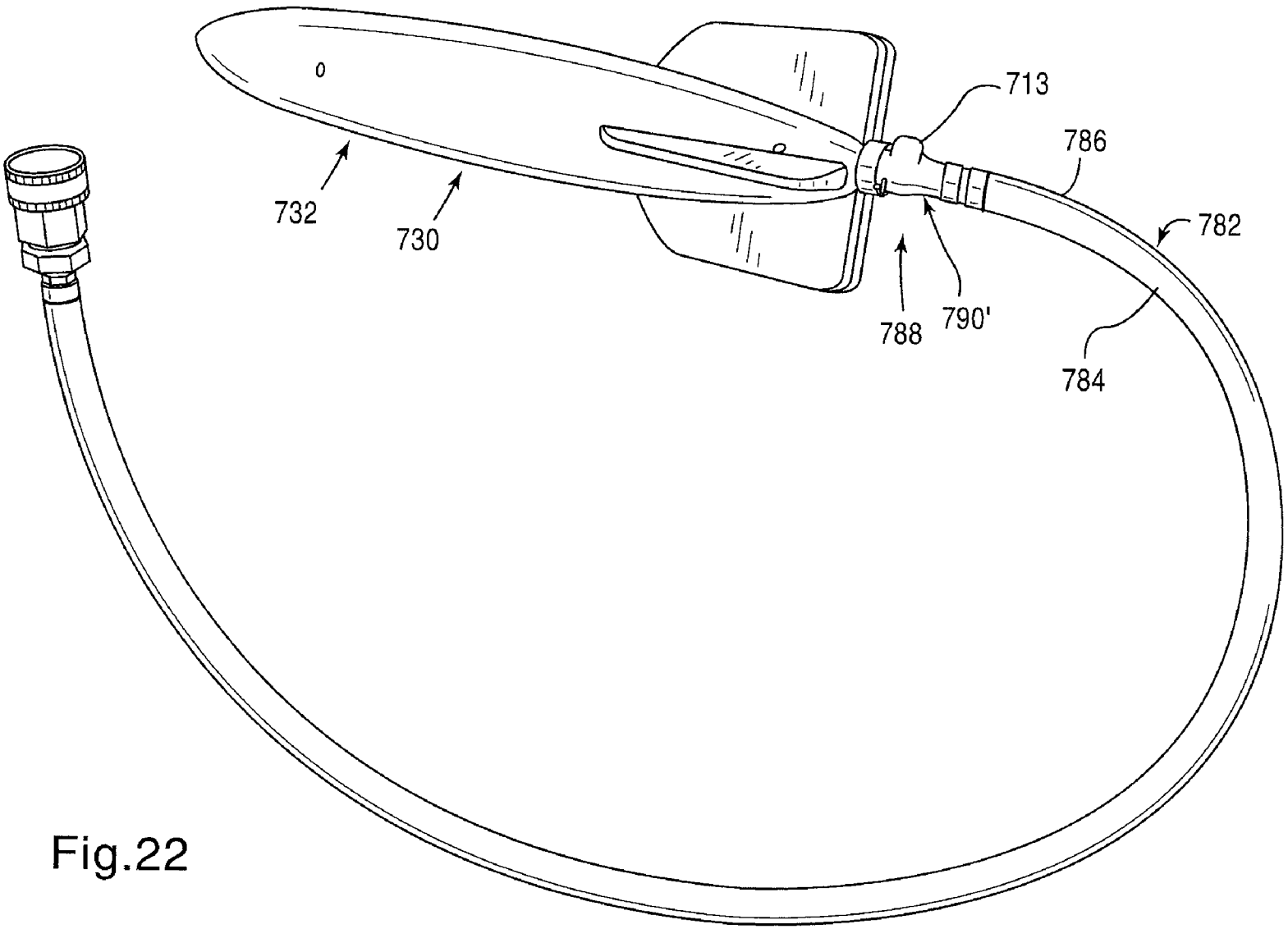
FIG. 22 is a top plan view of the toy of FIG. 19 coupled to the portion of the hose assembly shown in FIG. 21.

As best shown in FIG. 21, the body of the toy 730 includes optional buoyancy-adjusting material 715 (also referred to as a buoyancy-adjustment member). Material or member 715 can be added to the body 732 of the toy 730 to adjust the buoyancy of the toy 730, such as to make the toy 730 positively, negatively, or neutrally buoyant. As such, material 715 can be selected to increase or decrease the buoyancy that the toy 730 would have if the material was not present. Material 715 may additionally or alternatively be used to define the neutral orientation of the toy 730 in a body of water, such as by making a portion of the toy 730 more buoyant than another portion of the toy 730. For example, the material 715 can be used to bias the nose or tail sections 734, 736 of the toy 730 toward or away from the surface of the body of water and/or to define a rotational orientation of the toy 730 (relative to the toy's long axis). In other embodiments where the body itself provides sufficient buoyancy, the buoyancy-adjusting material may not be needed or can be monolithically formed with the body.

Figure 23:
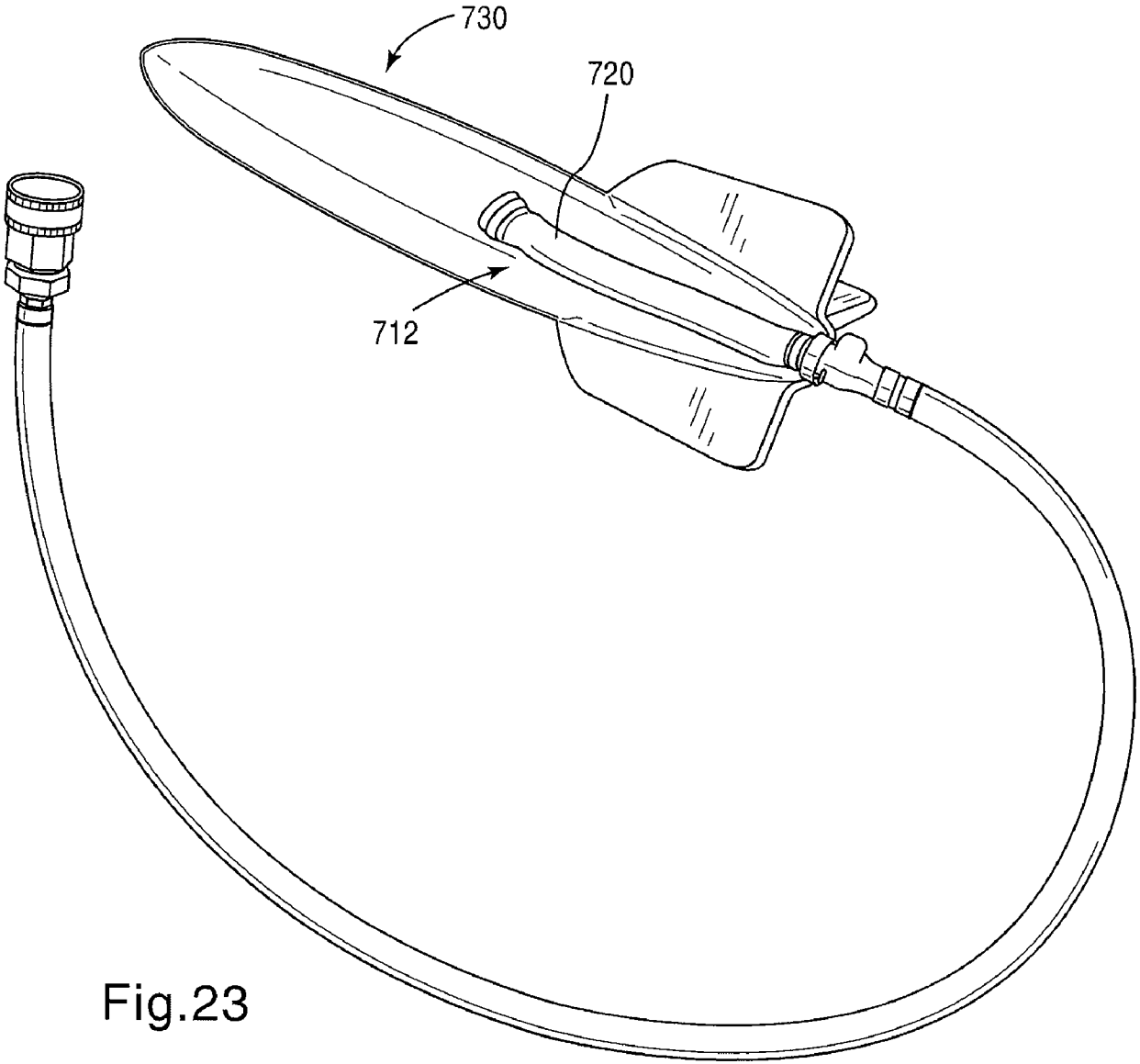
FIG. 23 is a partial cross-sectional plan view of the toy and the hose assembly of FIG. 22 with the reservoir of the propulsion mechanism in a uncharged configuration.
Figure 24:
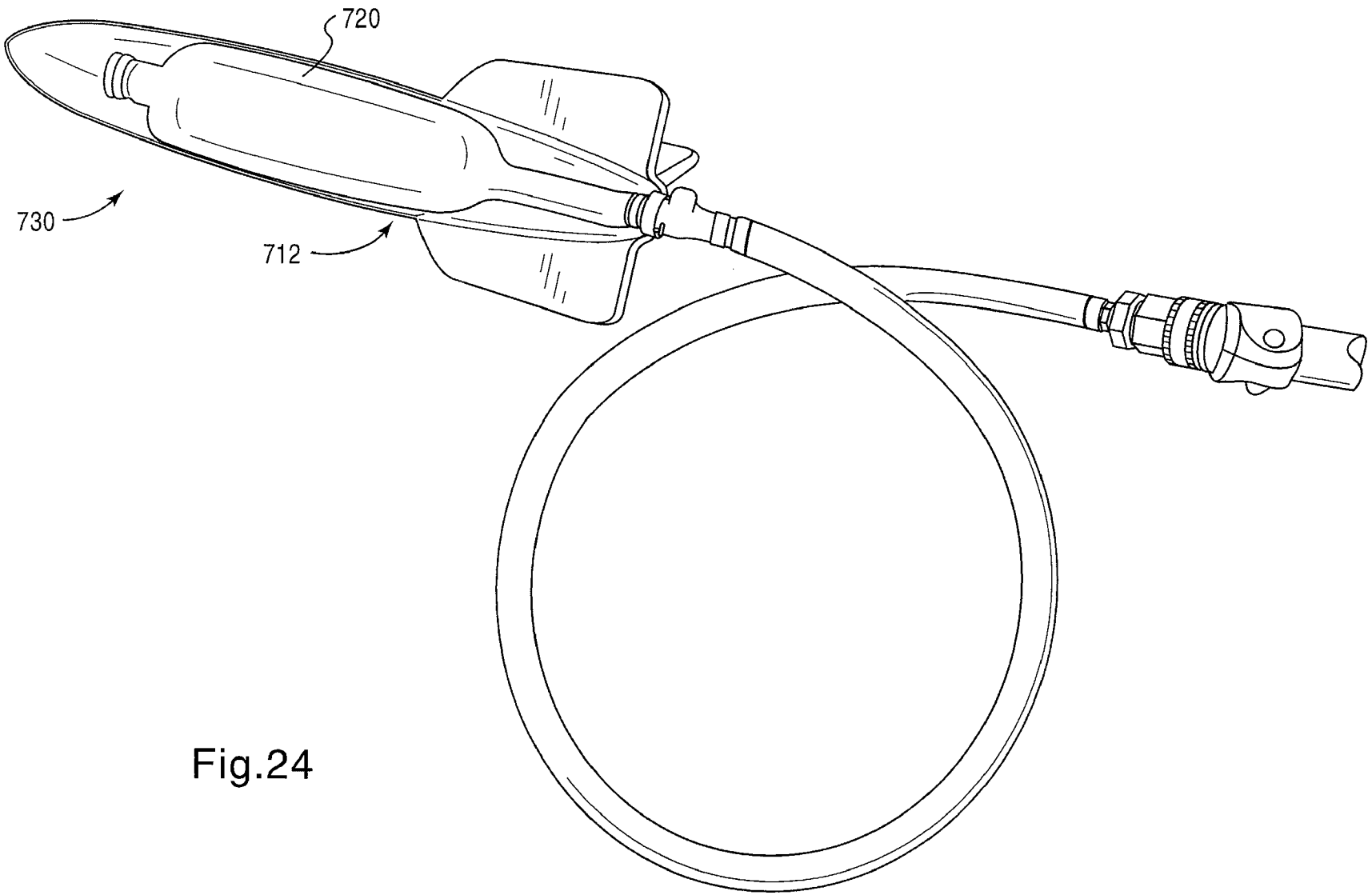
FIG. 24 is a partial cross-sectional plan view of the toy and the hose assembly of FIG. 23 with the reservoir of the propulsion mechanism in a charged configuration.

In FIG. 23, the toy's internal propulsion mechanism 712, which is depicted as a bladder-containing propulsion mechanism, is shown with a reservoir 720 in an uncharged configuration. An illustrated charged configuration of the reservoir 720 is shown in FIG. 24. As illustrated, the reservoir 720 has increased in length and width compared to its uncharged configuration. In FIG. 21, propulsion mechanism 712 is shown removed from the body 732 of toy 730. As discussed previously, the toy can be constructed to permit removal and replacement of its propulsion mechanism, such as for maintenance or repair and/or to use a propulsion mechanism having, for example, a different configuration, degree of propulsion, and/or water-emitting configuration. The propulsion mechanisms illustrated herein can also be used without an overlying shell, or body, 732.

FIGS. 25-37 illustrate examples of a toy according to other embodiments of the invention. As discussed, the particular (individual) elements, or components, may be implemented with any of the other elements, or components, described, illustrated and/or incorporated herein.

FIG. 25 illustrates a toy 830 that includes an exit port 826 having an adjustable orientation relative to a longitudinal axis A of the toy 830. For example, the exit port 826 can include a nozzle or outlet 847 whose orientation can be adjusted by pivoting or otherwise adjusting a hinge or joint 849 that couples the nozzle 847 to the body of the toy 830. A hollow ball joint, through which water may flow as the water is expelled through the nozzle 847 of the exit port 826, can be used, as well as other suitable constructions. The orientation of the adjustable outlet or nozzle 847 can be selectively fixed, or set, by a user, such as through the inclusion of an adjustment mechanism 845 that restricts unintentional repositioning of the nozzle 847. As an example, an adjustable collar (not shown) can be used to secure the position of the previously described ball joint. The collar can be tightened to fix the orientation of the nozzle 847, and selectively released to permit reorienting of the nozzle 847. By adjusting the orientation of the nozzle 847, the direction at which water is expelled from the exit port 826 may be selected by a user.

FIG. 26 illustrates an embodiment of a toy 930 in which the charge of water that is expelled by the propulsion mechanism is expelled through exit ports 926 that extend from a rotational prop or propeller 957. The exit ports 926 extend in an orientation that drives the rotation of the propeller 957, which creates propulsive forces for the toy 930 via the blades 959 of the propeller 957. As illustrated, the propeller 957 is mounted on a rotational shaft 953 and includes internal fluid conduits 955. The orientation of the exit ports 926 illustrated in FIGS. 26-27 extend substantially perpendicular to a plane defined by the propeller 957; however, the exit ports 926 may be configured with other orientations, such as, extending at least partially in a rearward orientation. Such an orientation can provide propulsive forces directly from the emission of the water as well as from the rotation of the propeller 957.

Figure 28:
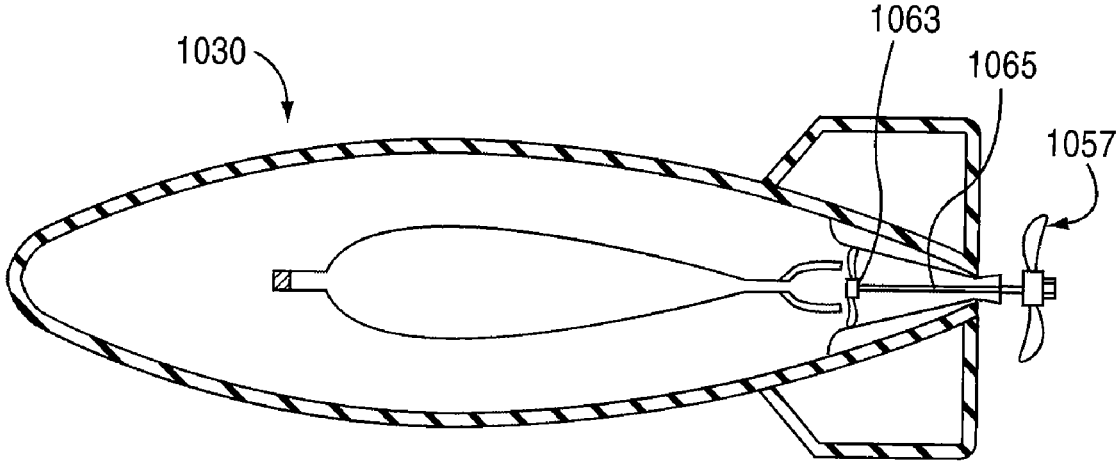
FIG. 28 is a cross-sectional view of another toy according to an embodiment of the invention.

FIG. 28 illustrates another embodiment of a toy 1030 that includes a propeller 1057. In the illustrated example, water emitted by the toy's propulsion mechanism is adapted to spin a rotational turbine 1063 that is mechanically interconnected (such as by drive shaft 1065) with propeller 1057. The rotation of the turbine 1063 drives the rotation of the propeller 1057, which in turn generates propulsive forces for the toy 1030. The emitted water may, but is not required to, also create propulsive forces. In some embodiments, the motor can be a piston motor, a vane motor or other type of appropriate motor instead of a rotational turbine.

Figure 29:
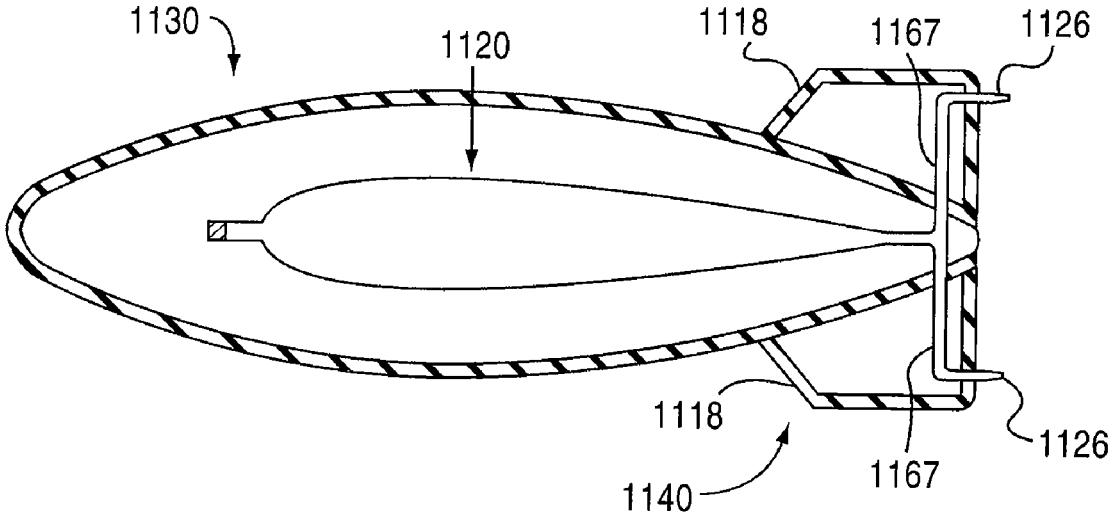
FIG. 29 is a cross-sectional view of another toy according to an embodiment of the invention.

FIG. 29 illustrates an embodiment of a toy 1130 that includes more than one exit port 1126. In this embodiment, the exit ports 1126 extend from the toy's trajectory-stabilizing structure 1140 (i.e., fins 1118). As shown, the fins 1118 include internal conduits 1167 through which the water expelled from the toy's reservoir 1120 flows to the exit ports 1126. Although not required, the orientation of the exit ports 1126 relative to a longitudinal axis of the toy's body (and/or each other) can be selected to impart axial spin to the toy 1130 as the propulsion mechanism operates. The orientation of the exit ports can also be selected (or adjusted) to define a curved or non-linear, trajectory as the toy travels through a body of water. When more than one exit port is present, the orientation of the exit ports can be adjustable within an angular range. Also, any of the exit ports disclosed, illustrated and/or incorporated herein may include adjustable orifices, that can be used to adjust the degree of propulsion and/or the rate at which water is emitted from the exit port(s).

Figure 30:
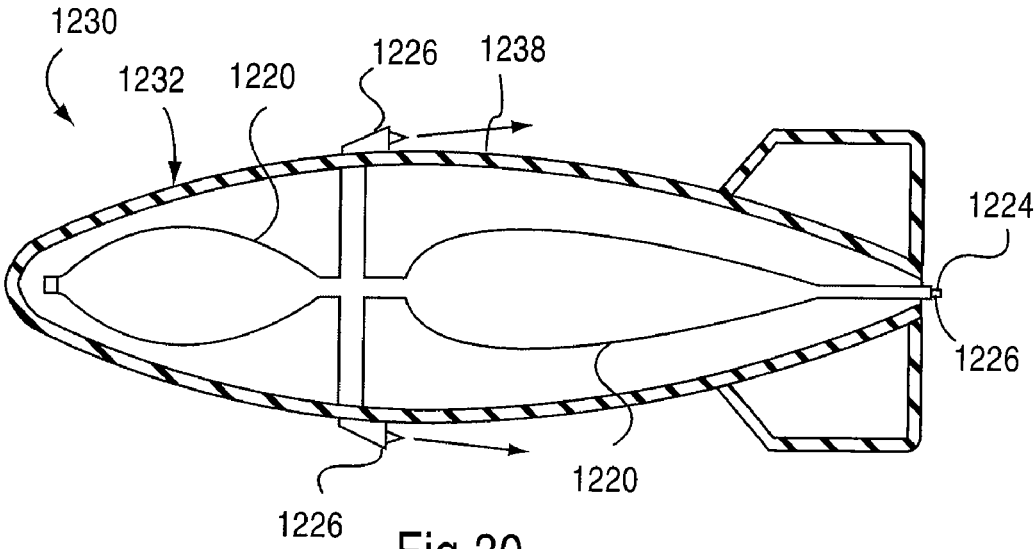
FIG. 30 is a cross-sectional view of another toy according to an embodiment of the invention.
Figure 31:
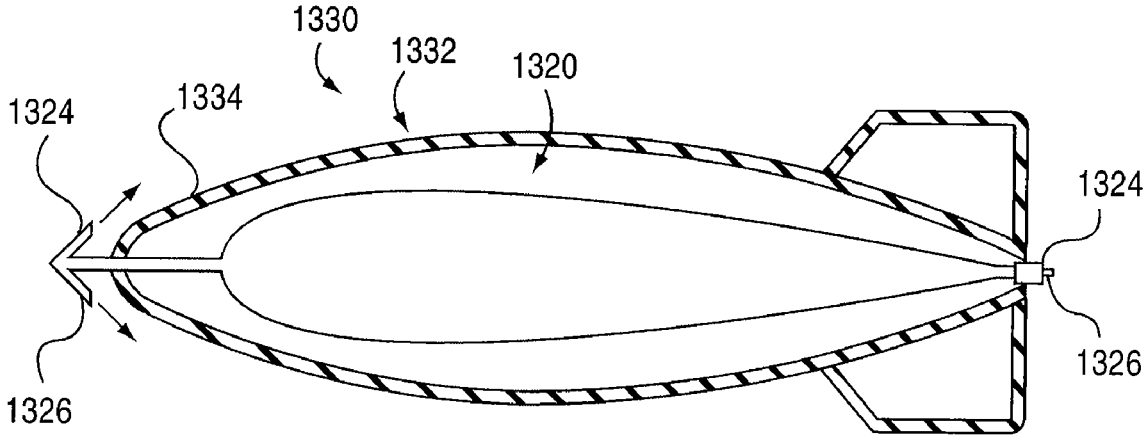
FIG. 31 is a cross-sectional view of another toy according to an embodiment of the invention.

FIG. 30 illustrates an embodiment of toy 1230 that includes exit ports 1226 that extend from the mid-section 1238 of the toy's body 1232 instead of the tail section 1236. FIG. 31 illustrates an embodiment of a toy 1330 in which the exit ports 1326 extend from the nose section 1334 of the toy's body 1332. Each of the illustrated embodiments also includes a port associated with the tail section 1336 of the body 1332. This port can be a fill port 224, an exit port 226 or function as both a fill port and an exit port. A check valve or one-way valve can also be coupled to the port 1324, 1326. Similar to the previously described embodiments, any of the exit ports can have a predefined axial or other orientation and/or an adjustable orientation.

Figure 32:
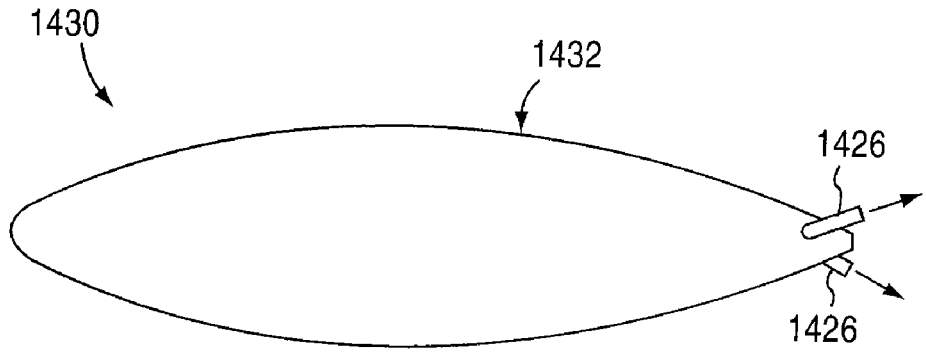
FIG. 32 is a side elevation view of another toy according to an embodiment of the invention.

FIG. 32 illustrates an embodiment of a toy that does not include a trajectory-stabilizing structure in the form of fins, foils or other projecting structures. Instead, the toy 1430 includes a plurality of complimentary oriented exit ports 1426 that are oriented to provide spin-stabilization to the toy 1430 as the toy 1430 is propelled through a body of water.

Figure 33:
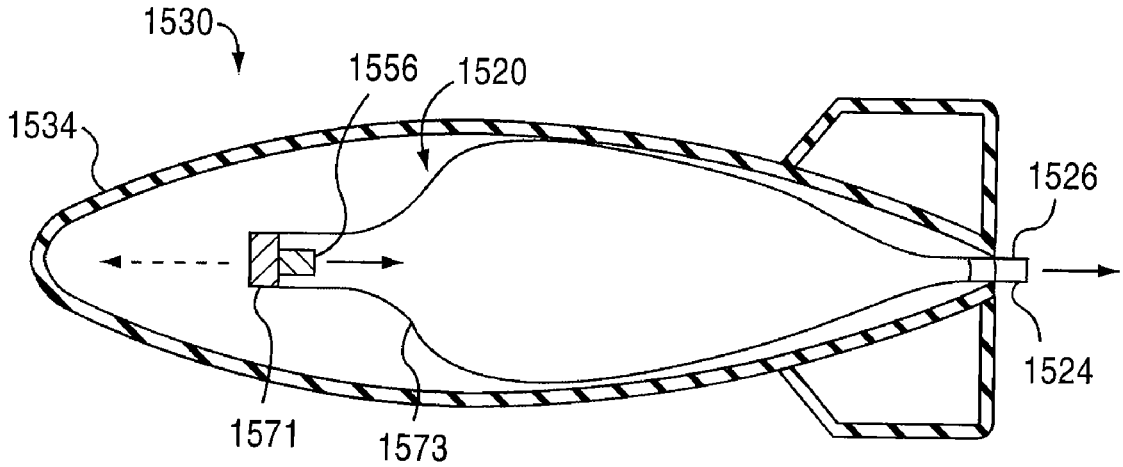
FIG. 33 is a cross-sectional view of another toy according to an embodiment of the invention.

FIG. 33 illustrates an embodiment of a toy 1530 in which a distal end region (or forward end) 1556 of a reservoir 1520 includes a weight 1571 so that the distal end region 1556 is heavier than a corresponding central portion 1573 of the reservoir 1520. As the reservoir 1520 is charged with water, the reservoir 1520 expands in length and thereby urges the weight forward toward the nose section 1534 of the toy's body 1532. This forward movement of the weight 1571 configures the toy to have a center of gravity in a forward half of the toy 1530, with the toy 1530 thereby initially being biased to a downwardly pitched orientation in a body of water. As the toy 1530 is initially propelled, this downward pitch will bias the toy 1530 to dive in the water. As the charge of water is dispelled through the toy's exit port 1526, a length of the reservoir 1520 is reduced and the weight is drawn toward the exit port 1526. This moves the toy's center of gravity rearward, such as to bias the toy 1530 to a neutral (horizontal) configuration, or an upwardly pitched orientation that will urge the toy 1530 to climb as it travels through the body of water.

Figure 34:
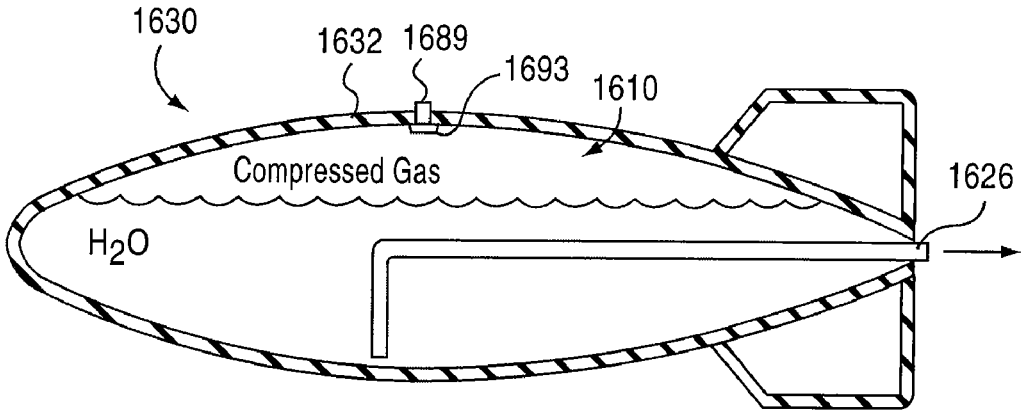
FIG. 34 is a cross-sectional view of another toy according to an embodiment of the invention.

FIG. 34 illustrates a toy 1630 that is adapted to be charged, not only by a charge of water, but also by a charge of pressurized gas, such as air. The pressurized gas urges water within the toy's internal compartment 1610 to be expelled through an exit port 1626. As the charge of water is emitted from the toy 1630, the buoyancy of the toy 1630 will tend to increase, thereby biasing the toy 1630 to rise in the body of water. In such an embodiment, an air inlet 1689 can be coupled to or defined by the body 1632. A one-way valve 1693 can be coupled to the air inlet 1689. In some embodiments, an on/off valve can alternatively be used. In some embodiments, the chamber containing the compressed gas can be a separate expandable chamber within the reservoir such that the expandable chamber compresses when the reservoir is filled with fluid, and expands when the fluid is exhausted or expelled from the reservoir.

Figure 35:
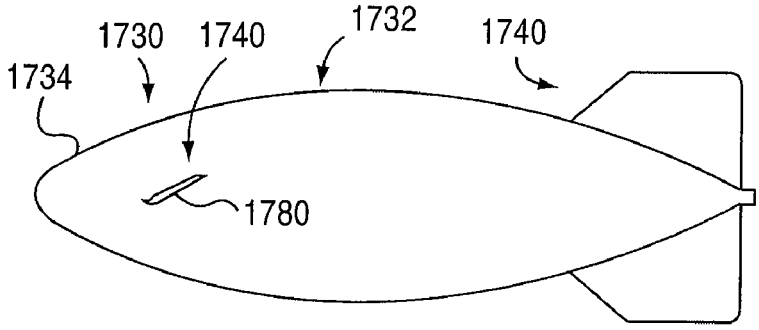
FIG. 35 is a side elevation view of another toy according to an embodiment of the invention.
Figure 36:
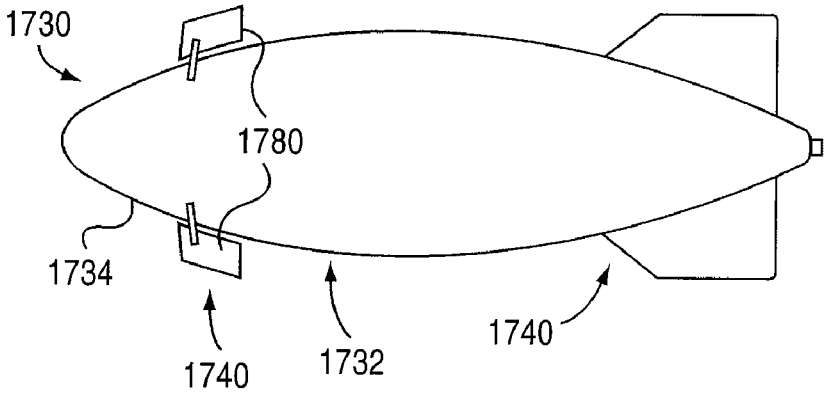
FIG. 36 is a top plan view of another toy according to an embodiment of the invention.

FIGS. 35 and 36 illustrate an embodiment of toy 1730 that includes a trajectory-stabilizing structure in the form of multiple bow planes 1780 that extend from the nose section 1734 of the toy's body 1732. The bow planes 1780 can be oriented in a fixed orientation relative to the body 1732, or can be configured to be adjustable relative to the body 1732.

Figure 37:
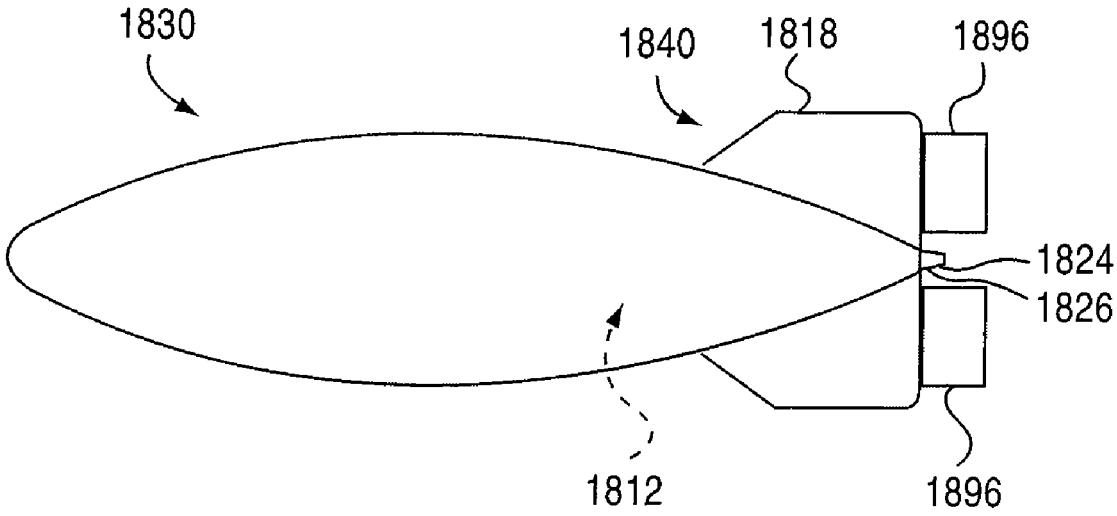
FIG. 37 is a side elevation view of another toy according to an embodiment of the invention.

FIG. 37 illustrates a further example of a trajectory-stabilizing structure 1840 that can be used with toys according to an embodiment of the invention. As illustrated, a toy 1830 can include a trajectory-stabilizing structure in the form of fins 1818. The illustrated example further includes adjustable flaps 1896 that are adjustably coupled to the fins 1818. The flaps 1896 can be oriented to provide steering and/or righting moments to the toy 1830, such as to urge the toy 1830 in non-linear or linear paths of travel when propelled through a body of water by a propulsion mechanism 1812.

Figure 38:
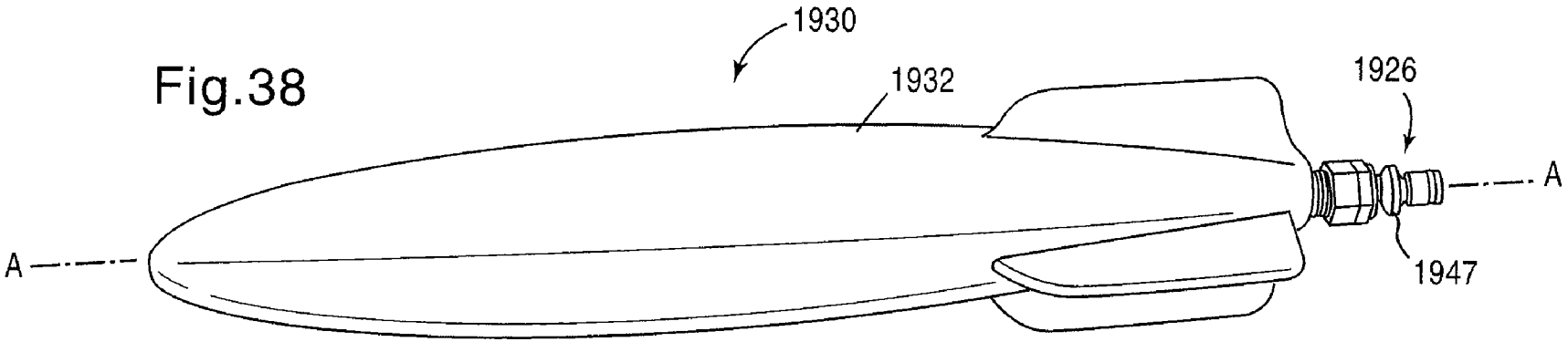
FIG. 38 is a plan view showing a toy according to an embodiment of the invention.
Figure 39:
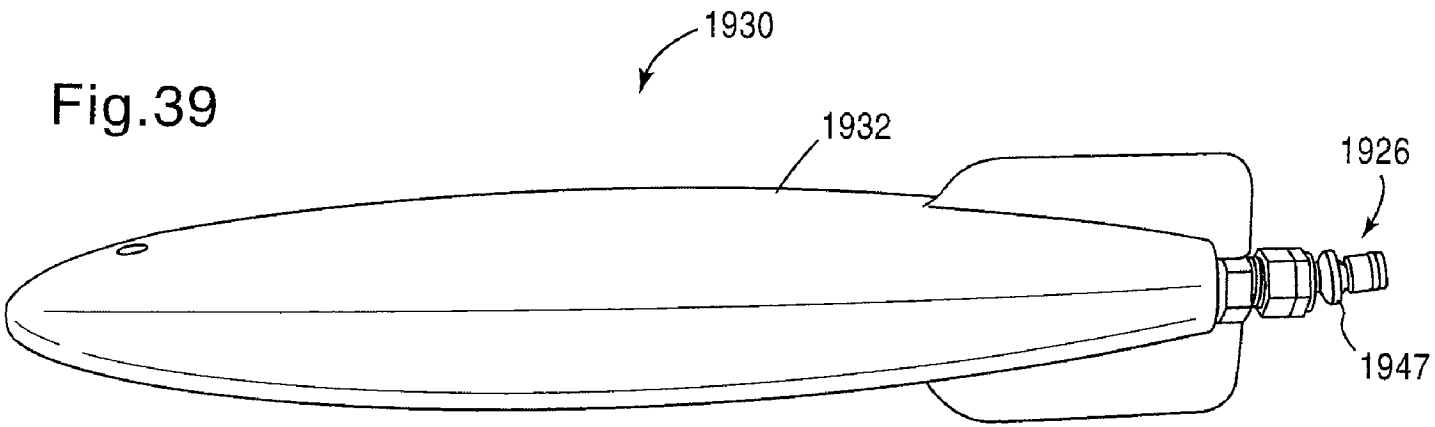
FIG. 39 is a plan view of the toy of FIG. 38 with the nozzle in an angular orientation.
Figure 40:
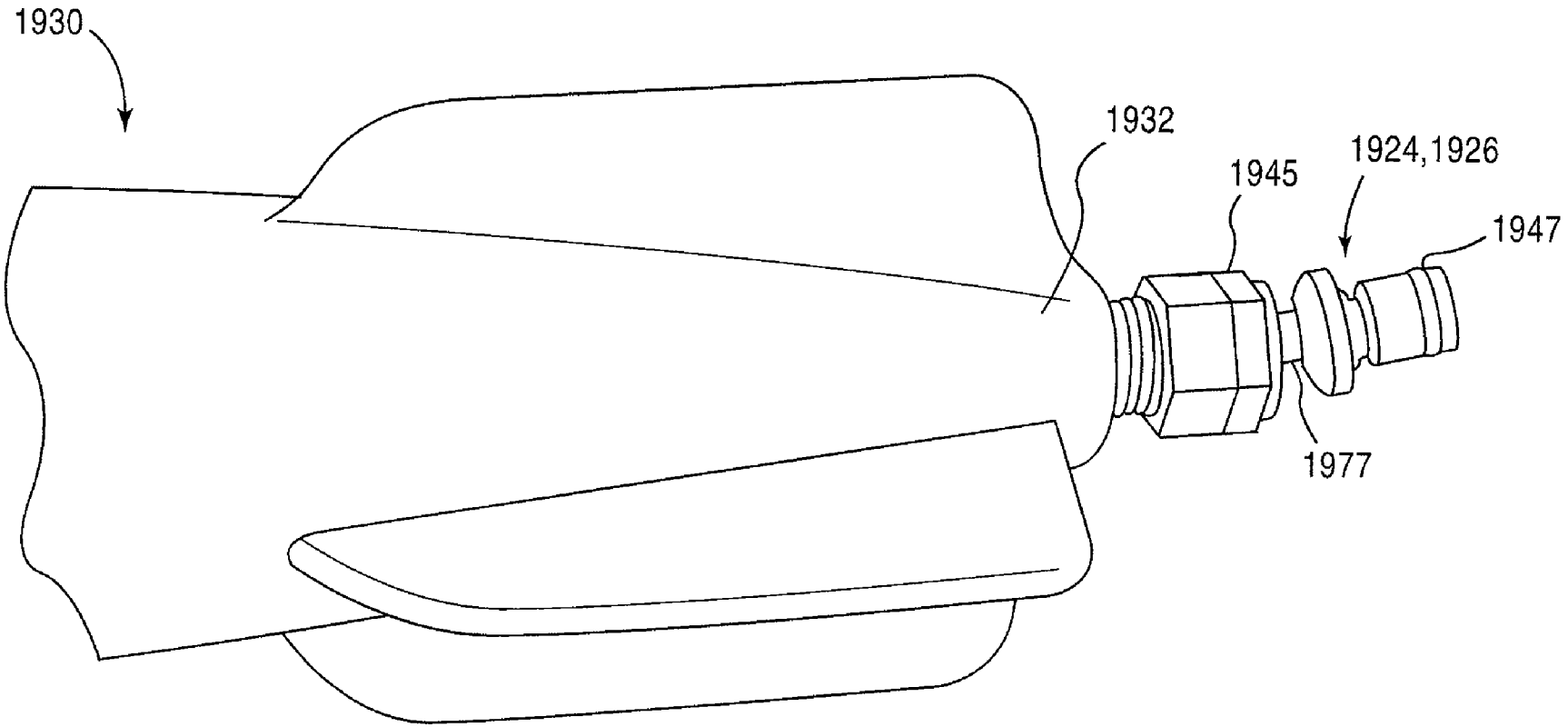
FIG. 40 is a plan view showing a portion of the toy of FIGS. 38 and 39.

FIGS. 38-40 illustrate a toy according to another embodiment of the invention. In this embodiment, the toy 1930 includes an exit port 1926 (which may also function as the input port 1924) that includes a nozzle 1947 having an adjustable orientation relative to a longitudinal axis of the toy 1930. As indicated in FIG. 40, the nozzle 1947 is mounted on a ball joint 1977 having a fluid conduit (not shown) extending therethrough. The radial orientation of the nozzle 1947 relative to a longitudinal axis A (shown in FIG. 38) defined by the body 1932 (and/or the tail section of the toy) can be selectively retained in a selected orientation by an adjustment mechanism 1945 in the form of a threaded fastener. FIG. 38 illustrates the nozzle 1947 substantially aligned with the longitudinal axis A, and FIGS. 39 and 40 illustrate the nozzle 1947 oriented at an angle relative to the axis A. The adjustment mechanism 1945 can be threaded onto an end of a fixed orientation portion of the exit port 1926 to retain frictionally the nozzle 1947 and ball joint 1977 in a selected orientation. By selecting a particular orientation, a user can selectively provide steering and/or righting moments to the toy, adjust the angle of attack and/or orientation of the toy during underwater travel propelled by the propulsion mechanism, etc. Similar to the above-discussed embodiments, the illustrated exit port 1926 and nozzle 1947 configuration can be used with any of the other components, subcomponents and configurations of toys described, illustrated and/or incorporated herein.

Figure 41:
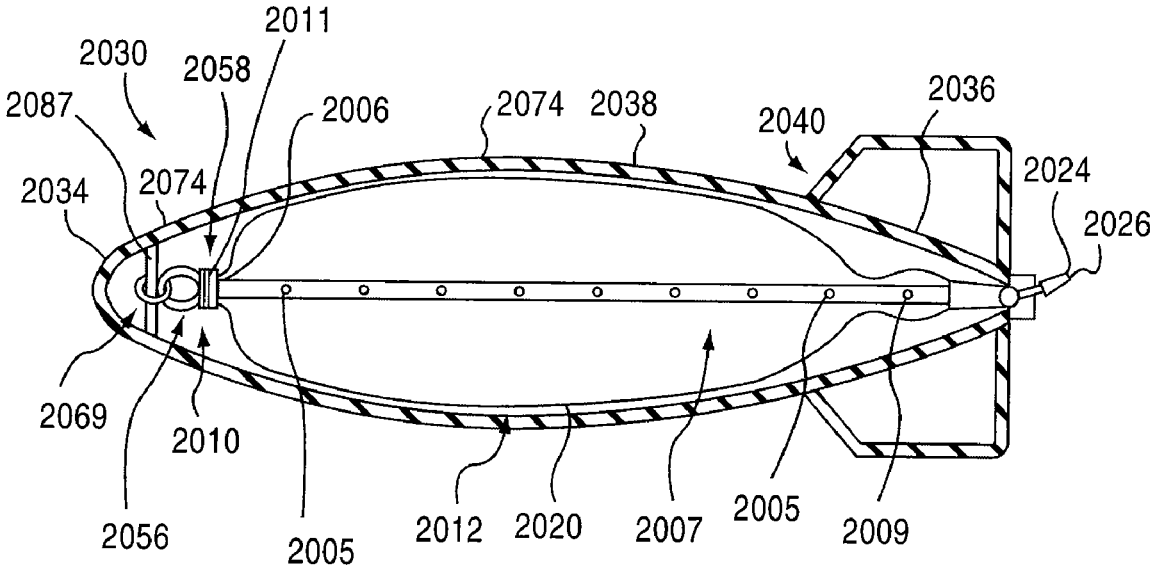
FIG. 41 is a cross-sectional view of another toy according to an embodiment of the invention.

As discussed previously, in some embodiments, for example, in embodiments that include a propulsion mechanism that includes an expandable elastomeric bladder, it may be desirable to restrict the bladder from being crimped during charging of the reservoir. An illustrative, non-exclusive configuration of a toy that includes a crimp-resisting structure is shown in FIG. 41. As shown in FIG. 41, the toy 2030 includes an elongate internal conduit 2007 that extends in fluid communication from the input (and/or exit) port 2024, 2026 through at least a third, if not at least half of the length of a reservoir 2020 (in at least its uncharged configuration and optionally in both the charged and uncharged configurations). Conduit 2007 has at least one opening 2005 distal to or spaced from the fill port/exit port 2024, 2026, and can include an opening 2005 at an end 2006 and/or a plurality of spaced-apart openings 2005 along its length. Conduit 412 can additionally or alternatively be formed from a porous material through which water within the reservoir may pass. Conduit 2007 can also include at least one opening 2009 proximate the fill port. When the reservoir 2020 is charged with water through fill port 2024, the conduit 2007 restricts crimping of the reservoir 2020.

Also shown in FIG. 41, the reservoir 2020 includes a second end region 2056 that is sealed with a sealing member 2058. The sealing member 2058 is a mechanical sealing mechanism in the form of a wire 2011 that is secured around second end region 2056 to prevent water from flowing therethrough. Other types of sealing mechanisms can alternatively be used. The illustrated example also demonstrates an example of a propulsion mechanism 2012 that includes an elastomeric reservoir 2020 with a second end region 2056 that is retained proximate the nose section 2034 of the toy 2030 by a fastening mechanism 2069. As shown, the internal compartment 2010 of the toy includes a support or support assembly 2087 around which the second end region of the reservoir 2020 is looped or otherwise coupled and thereafter secured by the sealing member 2058 to prevent removal of the second end region from the support 2087. Support 2087 can be integrally formed with the body or shell 2032 of the toy 2030 or secured to the body 2032 after formation of the body 2032. Similarly support 2087 may be formed from a single component, or more than one component.

FIGS. 42-44 illustrate yet another self-propelled toy according to an embodiment of the invention. In this embodiment, the propulsion mechanism includes a manual powered pump to deliver fluid to the reservoir. A toy 2130 includes a body 2132 including a nose section or first portion 2134 and a tail section or second portion 2136. A propulsion mechanism 2112 is coupled to the body 2132. A stabilizer 2140 in the form of a foil or annular ring is disposed at an end of the tail section 2136 as illustrated in FIGS. 42-44. The toy 2130 also includes multiple planes 2180 disposed along an outer surface 2197 of the body 2132.

The propulsion mechanism 2112 includes a manual pump 2113 coupled to, and in fluid communication with, an expandable reservoir 2120. The expandable reservoir 2120 is disposed within an interior compartment 2110 defined by the tail section 2136 of the body 2132. In this embodiment, the expandable reservoir 2120 includes elasticized or elastomeric walls that can expand or deform when the reservoir is being filled with a liquid, gas or solid material, such as water or air. For example, the expandable reservoir 2120 can be partially or completely formed from an elastomeric, flexible or stretchable material. The expandable reservoir 2120 can also be formed according to methods described with reference to reservoir 2120 illustrated in FIGS. 11-15. As such, the expandable reservoir 2120 defines a first interior volume (not shown in FIGS. 42-44) when not charged with a volume of fluid and a second (greater) volume when the expandable reservoir 2120 is charged with a volume of fluid.

The pump 2113 includes an outer sleeve 2123 and an inner sleeve 2125 movably disposed within the outer sleeve 2123. A one-way valve 2121 is coupled to the inner sleeve 2125, and will be described in more detail below.

An inlet port 2124 is coupled to and in fluid communication with the pump 2113. The inlet port 2124 extends through the nose section 2134 such that it is accessible from an exterior of the toy 2130 through an opening 2137 defined by the nose section 2134. A one-way valve 2193 is coupled to the inlet port 2124, the function of which will be described in more detail below. An outlet port 2126 is coupled to and in fluid communication with the expandable reservoir 2120. The outlet port 2126 extends at least partially through an opening 2139 defined by the tail section 2136 and an opening 2141 defined by the stabilizer 2140. A valve 2192 is coupled to the outlet port 2126 that can be actuated to selectively open and close the outlet port 2126.

A forward or first portion of the pump 2113 is coupled to the nose section 2134; a rearward or second portion of the pump 2113 is coupled to the tail section 2136. When the pump 2113 is actuated (e.g., manually pumped) the nose section 2134 and the tail section 2136 are displaced relative to each other. For example, the nose section 2134 can be moved relative to the tail section 2136 to pump or draw fluid through the inlet port 2124 and into the expandable reservoir 2120. In alternative embodiments, the tail section can be displaced relative to the nose section to draw fluid into the expandable reservoir 2120. Thus, the body can include multiple portions or sections, and various portions can be moved relative to each other to actuate a pump to draw fluid into the expandable reservoir.

FIG. 42 illustrates the propulsion mechanism 2112 in a first or extended configuration in which the nose section 2134 is displaced forward of the tail section 2136, and FIG. 43 illustrates the propulsion mechanism 2112 in a second or collapsed configuration in which the nose section 2134 is moved to a position closer to the tail section 2136 than in the first or extended configuration.

To pump fluid into the expandable reservoir 2120, the on/off valve 2192 is placed in a closed configuration, and the inlet port 2124 is placed or submerged in a body of fluid. With the inlet port 2124 submerged in the body of fluid, the propulsion mechanism 2112 is moved to the first or extended configuration, which causes fluid to be drawn through the inlet port 2124, through the one-way valve 2193 and into an interior of the sleeve 2123 of the pump 2113. In this configuration, the expandable reservoir 2120 is in an uncharged configuration (e.g., contains substantially no fluid) and defines a first volume. The one-way valve 2193 allows fluid to flow into the interior portion 2123 of the pump 2113, but prevents the fluid from flowing back out of the pump 2113. In alternative embodiments, a one-way valve for the inlet port is not included, and other means for capping or closing the inlet port can be used. For example, an on/off valve similar to valve 2192 can be coupled to inlet port 2124, such that a user can place the valve in an on position to draw fluid into the pump 2113 and then turn the valve to an off position to contain the fluid within the pump 2113. In another example, a user can place a finger or thumb over the inlet port 2124, or place a cap on the inlet port to contain the fluid within the pump 2113. Likewise, the on/off valve 2192 coupled to the outlet 2126, can be replaced with a one-way valve.

To charge or fill the expandable reservoir 2120 with the fluid contained within the interior portion 2123 of the pump 2113, the propulsion mechanism 2112 is moved to the second or collapsed configuration. FIG. 43 illustrates the propulsion mechanism 2112 in the second or collapsed configuration When the propulsion mechanism 2112 is moved from the first or extended configuration to the second or collapsed configuration, fluid contained within the interior portion 2123 of the pump 2113 is forced through the one-way valve 2121, through an interior of the inner cylinder 2125 of the pump 2113, and into the expandable reservoir 2120. In this configuration, the expandable reservoir 2120 defines a second volume greater than the first volume, as shown in FIG. 43. This pumping action can be repeated as necessary until the expandable reservoir 2120 is substantially fully pressurized with fluid and is in a charged configuration.

The fluid introduced into the expandable reservoir 2120 is temporarily contained within the expandable reservoir 2120 due to the valve 2192 being in the closed configuration. The fluid contained within the expandable reservoir 2120 is pressurized due to pumping forces when the fluid was introduced into the expandable reservoir 2120 and/or due to biasing forces of the expandable reservoir 2120.

To propel the toy 2130 through a body of water, the valve 2192 can be moved to an open configuration. With the valve 2192 open, the biasing force of the expandable reservoir 2120 biases the expandable reservoir 2120 to return to an uncharged configuration and, therefore, urges the pressurized fluid contained within the expandable reservoir 2120 to be released or expelled through the outlet port 2126, and outside of the toy 2130. FIG. 44 illustrates the toy 2130 submerged in a body of water BW and pressurized fluid F exiting the outlet port 2126.

Figure 45:
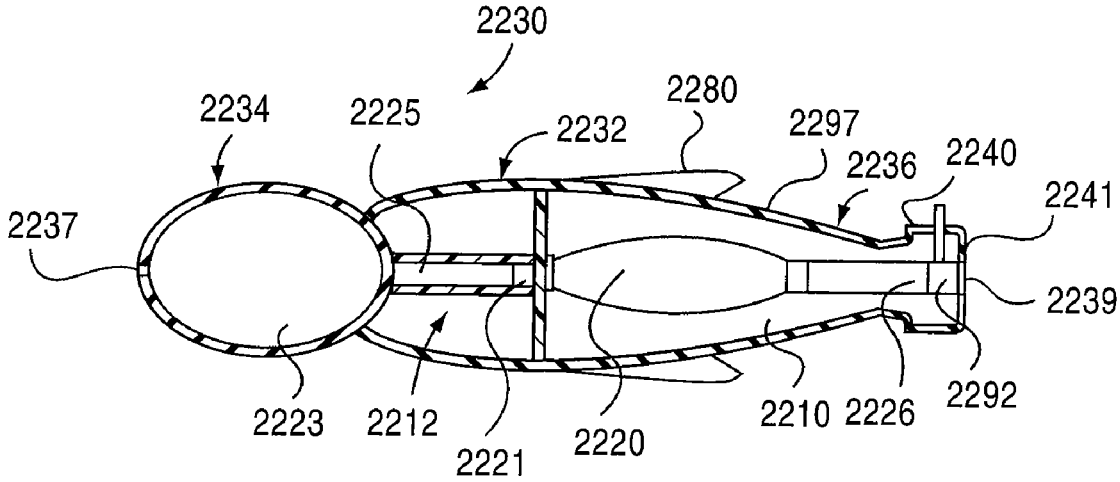
FIG. 45 is a side view shown partially in cross-section of a toy in an expanded configuration according to an embodiment of the invention.
Figure 46:
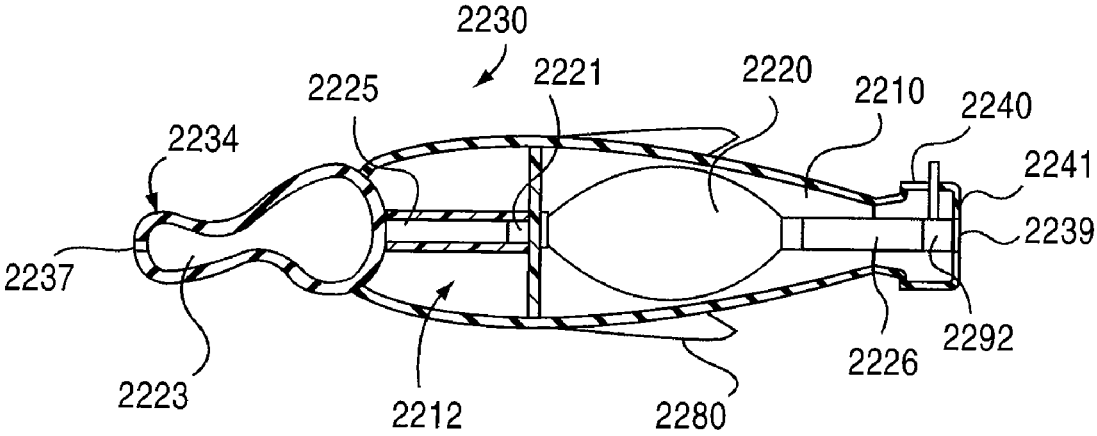
FIG. 46 is a side view of the toy of FIG. 45 shown in a collapsed configuration.

FIGS. 45-46 illustrate a self-propelled toy according to another embodiment of the invention. In this embodiment, the propulsion mechanism includes a squeezable bladder to deliver fluid to an expandable reservoir. A toy 2230 includes a body 2232 having a nose section or first portion 2234 and a tail section or second portion 2236. A propulsion mechanism 2212 is coupled to the body 2232. A stabilizer 2240 in the form of a foil or annular ring is disposed at an end of the tail section 2236. The toy 2230 also includes multiple planes 2280 disposed along an outer surface 2297 of the body 2232.

The propulsion mechanism 2212 is coupled to the body 2232 and includes an expandable reservoir 2220. The expandable reservoir 2220 is disposed within an interior compartment 2210 defined by the tail section 2236 of the body 2232. In this embodiment, the expandable reservoir 2220 includes elastomeric walls and can be formed substantially the same as the expandable reservoir 520 described above. As such, the expandable reservoir 2220 defines a first interior volume when not charged with a volume of fluid, and a second (greater) volume when the expandable reservoir 2220 is charged with a volume of fluid.

The nose section 2234 is also formed of an elastomeric material and can be formed similar to the expandable reservoir 2220. The nose section 2234 defines an interior region 2223 that has a volume that can vary as is described in more detail below. The propulsion mechanism 2212 includes the nose section 2234 and a sleeve 2225 that is in fluid communication with the expandable reservoir 2220. The propulsion mechanism also includes a one-way valve 2221 that is coupled to the sleeve 2225.

An opening 2237 is defined by the nose section 2234 that provides access to the interior volume 2223 of the nose section 2234 from an exterior of the toy 2230. In some embodiments, a one-way valve (not shown in FIGS. 45 and 46) can be coupled to the opening 2237. An outlet port 2226 is coupled to and in fluid communication with the expandable reservoir 2220. The outlet port 2226 extends at least partially through an opening 2239 defined by the tail section 2236 and an opening 2241 defined by the stabilizer 2240. A valve 2292 is coupled to the outlet port 2226 that can be actuated to selectively open and close the outlet port 2226.

FIG. 45 illustrates the propulsion mechanism 2212 in a first or expanded configuration in which the nose section 2234 is shown in its biased expanded configuration. FIG. 46 illustrates the propulsion mechanism 2212 in a second or collapsed configuration in which the nose section 2234 has been squeezed or collapsed by a user to put the nose section 2234 in its collapsed configuration.

In this embodiment, to pump fluid into the expandable reservoir 2220, the valve 2292 is put in an off position, and the nose section 2234 is squeezed by a user while the opening 2237 is placed or submerged in a body of fluid. While the opening 2237 is still submerged in the body of fluid, the nose section 2234 is released such that it is allowed to assume its biased or expanded configuration. In doing so, fluid will be drawn into the interior region 2223 of the nose section 2234. The user can then place a thumb or finger over the opening 2237 or otherwise cap the opening 2237. For example, the toy can include a cap (not shown in FIGS. 45 and 46) configured to close the opening. In other embodiments, the toy can include a one-way valve coupled to the opening such that fluid can be drawn into the nose section, but cannot flow back out. In yet other embodiments the toy can include an on/off valve coupled to the opening, With the opening 2237 closed or capped, the fluid contained within interior region 2223 of the nose section 2234 can be pushed through the one-way valve 2221 and into the expandable reservoir 2220 by again squeezing the nose section 2234, as shown in FIG. 46. The one-way valve 2221 allows fluid to flow into the reservoir 2220, but prevents the fluid from flowing back out from the reservoir 2220 to the nose section 2234. This pumping or squeezing action can be repeated as necessary until the expandable reservoir 2220 is substantially fully pressurized with fluid and is in a charged configuration.

As with the previous embodiments, the fluid introduced into the expandable reservoir 2220 is temporarily contained within the expandable reservoir 2220 due to the valve 2292 being in the closed configuration. The fluid contained within the expandable reservoir 2220 is pressurized due to pumping forces when the fluid was introduced into the expandable reservoir 2220 and/or due to biasing forces of the expandable reservoir 2220.

To propel the toy 2230 through a body of water, the valve 2292 can be moved to an open configuration. With the valve 2292 open, the biasing force of the expandable reservoir 2220 biases the expandable reservoir 2220 to return to an uncharged configuration and, therefore, urges the pressurized fluid contained within the expandable reservoir 2220 to be released or expelled through the outlet port 2226, and outside of the toy 2230. Although not specifically shown, any of the components described with reference to the previous embodiments can also be incorporated in this embodiment.

Figure 47:
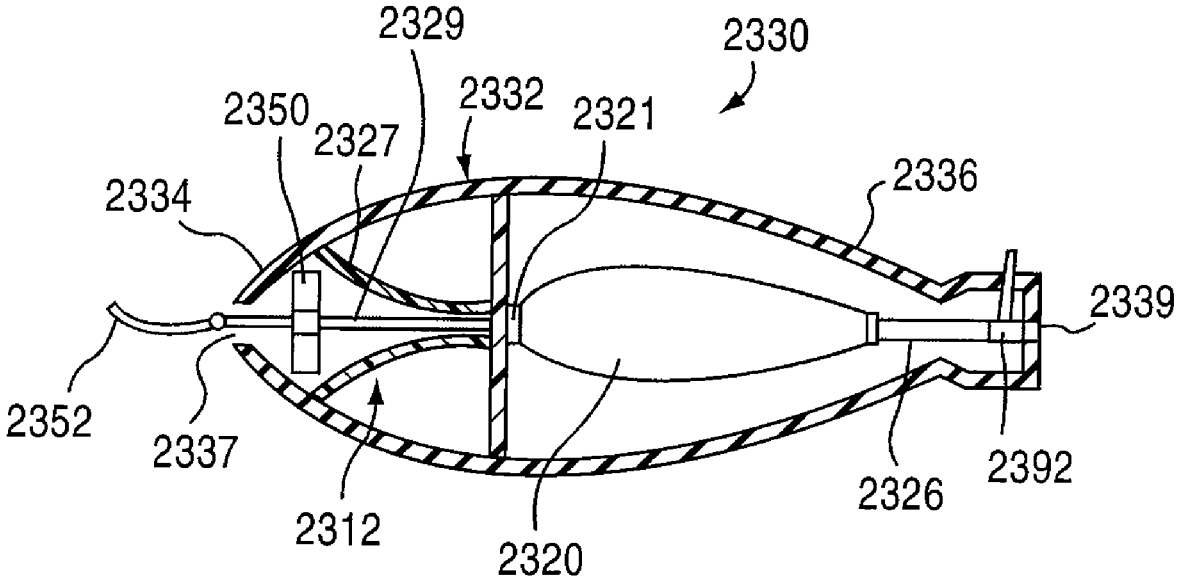
FIG. 47 is a side view shown partially in cross-section of a toy according to another embodiment of the invention.

In another embodiment of a self-propelled toy, centrifugal force is used to draw fluid into the reservoir of the toy. As shown in FIG. 47, a toy 2330 includes a body 2332 having a nose section 2334 and a tail section 2336. The nose section 2334 defines an opening 2337; the tail section 2336 defines an opening 2339. A propulsion mechanism 2312 is coupled to the body 2332. The propulsion mechanism includes an expandable reservoir 2320 coupled to and in fluid communication with a diffuser 2327. An outlet port 2326 is also coupled to the reservoir 2320 and extends through the tail section 2336 and is accessible to the exterior of the toy 2330 through the opening 2339. An on/off valve 2392 is coupled to the outlet port 2326.

The propulsion mechanism also includes an impeller 2350 that is rotatably coupled to the body 2332 via a shaft 2329. The impeller 2350 can be constructed, for example, similar to an impeller used in a centrifugal pump. A handle 2352 is coupled to the impeller 2350 and can be used to manually turn the impeller 2350. The handle 2352 can be folded such that it is positioned alongside an exterior surface of the body 2332. In some embodiments, a removable handle can be used that can be removably coupled to the impeller. Other suitable handle configurations can also be used. In some embodiments, a handle can extend perpendicular from a side of the body and include a gear mechanism to translate the rotation of the handle by a user into rotational motion of the impeller about the longitudinal axis of the impeller shaft. In an alternative to actuating the impeller using a handle, a toy can be constructed without a handle, in which case the user can move the toy through a body of water to actuate the impeller. For example, the motion of the toy through the body of water will cause water to flow through the impeller and drive or cause the impeller to rotate, drawing water into the reservoir.

In this embodiment, to pump fluid into the reservoir 2320, the toy 2330 is placed or submerged in a body of fluid with the valve 2392 in an off position. The handle 2352 is turned to rotate the impeller 2350, which draws fluid through the opening 2337, through the diffuser 2327, through the one-way valve 2321 and into the reservoir 2320. The user can continue to rotate the impeller 2350 until the reservoir 2320 is in a charged configuration. The handle 2352 can then be placed in a folded position as described above. As with the previous embodiments, the fluid contained within the reservoir can be released by moving the valve 2392 to an on position, which will propel the toy 2330 through the body of fluid. As stated previously, any of the components described with reference to the previous embodiments can also be incorporated in this embodiment.

Figure 48:
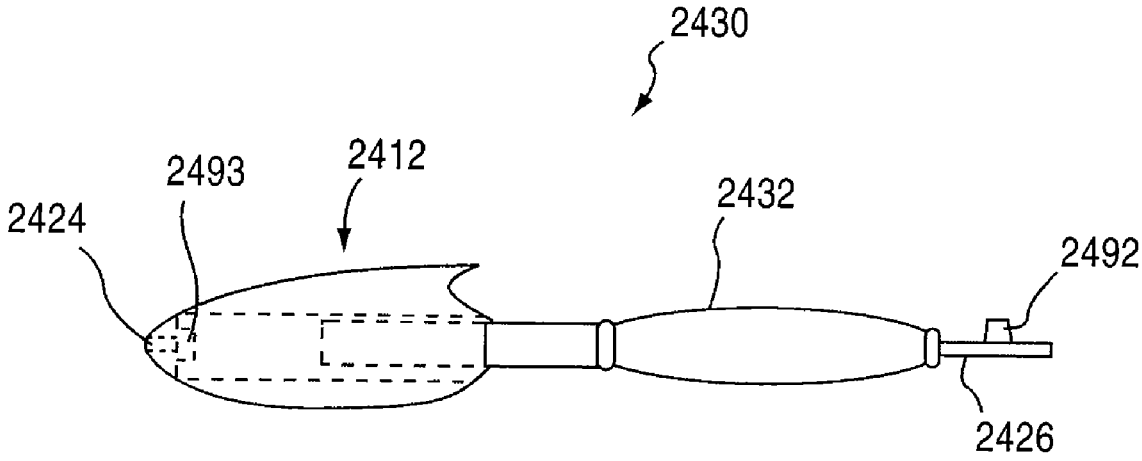
FIG. 48 is a side view of a toy shown in a collapsed configuration according to an embodiment of the invention.

In another embodiment, a toy can include a single body that defines a reservoir for containing fluid. In other words, in this embodiment, the toy has a single body/reservoir instead of a separate body and reservoir. As shown in FIG. 48, a toy 2430 includes an expandable body 2432 having elasticized or elastomeric walls that define an interior volume. The expandable body 2432 can stretch or expand such that the body changes shape as fluid is drawn into the interior volume of the body 2432. A propulsion mechanism 2412 is coupled to the body 2432. As shown in FIG. 48, a pump-type propulsion mechanism 2412, similar to the propulsion mechanism 2112 of FIGS. 42-43 is illustrated, however, any of the examples of a propulsion mechanism described herein can alternatively be used. Also, as shown is FIGS. 48 and 49, the propulsion mechanism can be enclosed or partially enclosed within a housing or other structure. An outlet port 2426 is coupled to or defined by the body 2432 and an on/off valve 2492 is coupled to the outlet 2426. An inlet port 2424 is coupled to the propulsion mechanism 2412 as previously described, and a one-way valve 2493 (or alternatively an on/off valve) is coupled to the inlet 2424.

Figure 49:
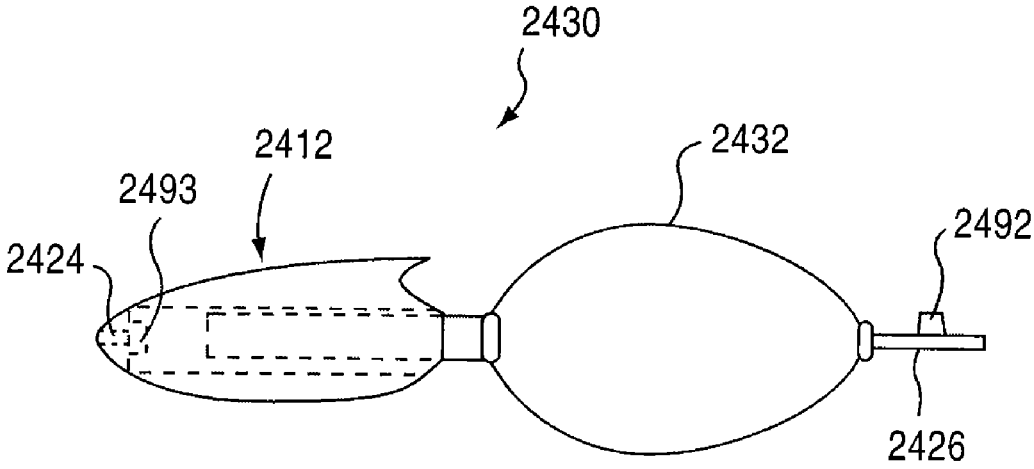
FIG. 49 is a side view of a toy of FIG. 48 shown in an expanded configuration.

To fill the expandable body 2432 with a fluid, the propulsion mechanism 2412 can be actuated or pumped as previously described with reference to FIGS. 42-43, to draw fluid into the expandable body 2432. The expandable body 2432 will stretch or expand, as shown in FIG. 49, as fluid is drawn into the interior volume of the body 2432. To propel the toy 2430, the on/off valve 2492 can be turned to an on position to expel the fluid from the body 2432.

Figure 50:
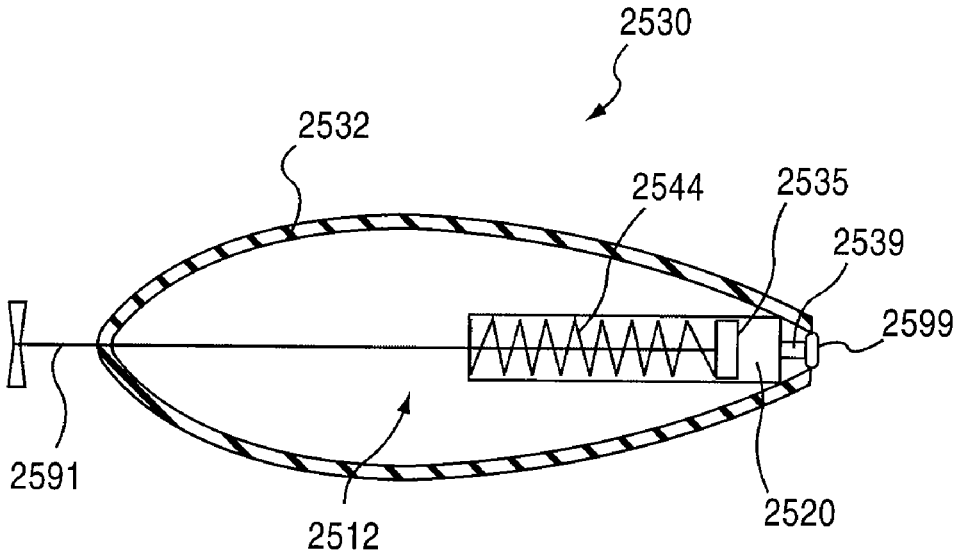
FIG. 50 is a side cross-sectional view of a toy shown in an uncharged configuration according to an embodiment of the invention.
Figure 51:
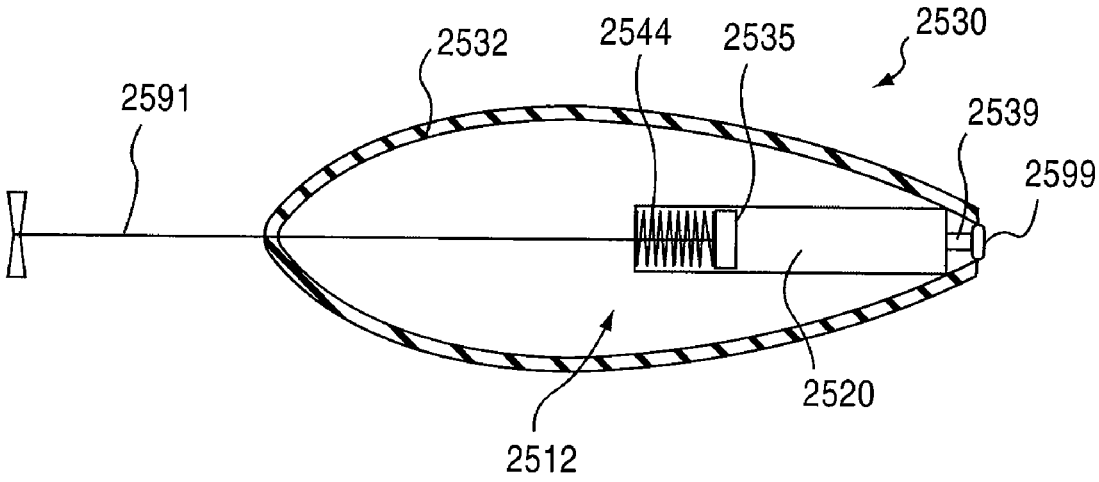
FIG. 51 is a side cross-sectional view of the toy of FIG. 50 shown in a charged configuration.

As a variation to the above-described propulsion mechanisms illustrated in FIGS. 8-10, a propulsion mechanism can include a piston coupled to a biasing member, such as a spring, and a pull cord to actuate the piston. In this embodiment, the piston can be manually pulled by the user with, a pull cord such that the piston is drawn against the bias of the biasing member. As shown in FIGS. 50 and 51, a toy 2530 includes a body 2532 and a propulsion mechanism 2512. The propulsion mechanism 2512 includes a piston 2535 coupled to a pull cord 2591, and a reservoir 2520. An inlet/outlet port or orifice 2539 is coupled to and in fluid communication with the reservoir 2520, and a flapper 2599 is coupled to the orifice 2539. The flapper 2599 substantially covers the orifice 2539, such that fluid can flow through the flapper 2599 and into the reservoir 2520, but is substantially contained within the reservoir 2520.

To draw fluid into the reservoir 2520 (e.g., move the toy 2530 from an uncharged configuration to a charged configuration), the orifice 2539 is placed in fluid, and the pull cord 2591 is then pulled by the user to draw the piston 2535 in a direction away from the reservoir 2520 and against the bias of the biasing member 2544. This will cause fluid to be drawn in through the orifice 2539 and into the reservoir 2520. When the user releases the pull cord (i.e., releases the piston), the biasing member 2544 will urge the piston 2535 toward the reservoir 2520, and force the fluid back out through the orifice 2539, propelling the toy 2530.

Although not specifically shown, any of the components described with reference to any of the embodiments herein can be incorporated with any embodiment. For example, the reservoir 2120 can be replaced with a reservoir similar to the reservoirs described with reference to FIGS. 8-10. Also, toy 2130 can include other optional features described above, such as, for example, a weight for shifting the center of gravity of the body, an outlet port having a repositionable nozzle or multiple outlet ports, a propeller, or a buoyancy adjustment member. In some embodiments, the inlet port of a toy 2130 can be configured to be coupled to a water supply or source of pressurized fluid as described herein, rather than pumping the fluid into the reservoir. In such an embodiment, the interior portion of the pump can, for example, be filled with fluid from the water supply and then the pump can be actuated to move the fluid into the expandable reservoir.

In addition, in any of the embodiments described herein, other types of propulsion mechanisms can be used to draw fluid into a toy and propel the toy when the fluid is expelled from the toy. For example, in some embodiments, a root-type blower or compressor having rotary blades can be used. In other embodiments, a vane-type compressor can be used.

The specific embodiments as disclosed and illustrated herein are not to be considered in a limiting sense as numerous variations are possible. Where the disclosure or subsequently filed claims recite "a" or "a first" element or the equivalent thereof, such disclosure or claims may be understood to include incorporation of one or more such elements, neither requiring nor excluding two or more such elements.

Applicant reserves the right to submit claims directed to certain combinations and subcombinations that are directed to one of the disclosed embodiments and are believed to be novel and non-obvious. Embodiments in other combinations and subcombinations of features, functions, elements and/or properties can be claimed through amendment of those claims or presentation of new claims in that or a related application.

What is claimed is:

1. An apparatus, comprising:

a body, the body defining a first portion and a second portion, the first portion of the body and the second portion of the body being movable relative to each other between a first configuration and a second configuration; and a propulsion mechanism fixedly coupled to the body, the propulsion mechanism including an expandable reservoir and a pump, the pump including an inner sleeve movably disposed within an outer sleeve, the outer sleeve being at least partially disposed within an interior region defined by the first portion of the body, the inner sleeve being at least partially disposed within an interior region defined by the second portion of the body, the first portion of the body defining an inlet port in fluid communication with the outer sleeve of the pump and the second portion of the body defining an exit port in fluid communication with the expandable reservoir, the expandable reservoir having elastomeric walls configured to contain a volume of liquid under pressure, the pump configured to draw liquid through the inlet port and into an interior region defined by the outer sleeve of the pump when the first portion of the body and the second portion of the body are moved from the first configuration to the second configuration, the pump configured to move the liquid disposed within the interior region of the outer sleeve of the pump into the expandable reservoir when the first portion of the body and the second portion of the body are moved from the second configuration to the first configuration, the propulsion mechanism configured to expel the liquid from the expandable reservoir and through the exit port to cause the body to be propelled while the apparatus is submerged in a liquid.

2. The apparatus of claim 1, wherein the pump is a manual pump.

3. The apparatus of claim 1, wherein the body defines at least one vent along an outer surface of the body, the at least one vent in fluid communication with an interior region of the body in which the expandable reservoir is disposed, the vent allowing fluid to be received within the interior region of the body such that the apparatus in its entirety maintains a neutral buoyancy disposed at a non-zero distance below a surface of the liquid in which the apparatus is submerged and maintains a fixed center of gravity as the liquid is being expelled from the expandable reservoir.

4. The apparatus of claim 1, wherein the body is couplable to a source of pressurized liquid.

5. The apparatus of claim 1, wherein the body defines an internal compartment, the expandable reservoir includes a first end and a second end, the first end of the expandable reservoir is coupled to a first end of the internal compartment, the second end of the expandable reservoir is coupled to a second end of the internal compartment.

6. The apparatus of claim 1, further comprising:

a valve coupled to the body at an exit port defined by the body and in fluid communication with the expandable reservoir, the valve being selectively movable between a closed configuration in which liquid is contained within the expandable reservoir and an open configuration in which liquid is expelled from the expandable reservoir.

7. The apparatus of claim 1, further comprising:

a buoyancy adjustment member coupled to the body.

8. The apparatus of claim 1, further comprising:

a nozzle coupled to the body, the nozzle defining an exit port in fluid communication with the expandable reservoir, the exit port being repositionable relative to a longitudinal axis defined by the body to adjust a direction of pressurized liquid when expelled from the expandable reservoir.

9. The apparatus of claim 1, further comprising a propeller coupled to the body, the propeller including a first exit port and a second exit port each in fluid communication with the expandable reservoir, the propeller configured to rotate and provide propulsion to the body when liquid is expelled from the expandable reservoir through the first and second exit ports.

10. The apparatus of claim 1, further comprising:

a stabilizer coupled to the body.

11. The apparatus of claim 1, wherein the body defines a first exit port and a second exit port, the first and second exit ports each configured to provide spin stabilization to the body when the body is propelled while submerged in a liquid.

12. The apparatus of claim 1, further comprising:

a weight coupled to the expandable reservoir, the body having a center of gravity defined in part by the weight.

13. The apparatus of claim 1, further comprising:

a one-way valve coupled to the pump, the one-way valve configured to allow liquid to be drawn through the inlet port and into the outer sleeve but prevent liquid from being expelled out of the outer sleeve and through the inlet port.

14. The apparatus of claim 13, wherein the one-way valve is coupled to the outer sleeve of the pump.

15. The apparatus of claim 13, wherein the one-way valve is a first one-way valve, the first one-way valve coupled to the outer sleeve of the pump, the apparatus further comprising:

a second one-way valve coupled to the inner sleeve of the pump, the second one-way valve configured to allow liquid to flow through the inner sleeve and into the expandable reservoir when at least one of the outer sleeve or the inner sleeve is moved relative to the other.

16. An apparatus, comprising:

an expandable body formed with elastomeric walls and having an expanded configuration and a collapsed configuration, the expandable body configured to receive a volume of liquid and store the liquid under pressure;

a housing coupled to the expandable body and defining an inlet port, the housing and the expandable body being movable relative to each other; and a propulsion mechanism fixedly coupled to the expandable body, the propulsion mechanism including a pump having an inner sleeve movably disposed within an outer sleeve, the outer sleeve being in fluid communication with the inlet port, the inner sleeve being in fluid communication with the expandable body, the outer sleeve being at least partially disposed within an interior region defined by the housing, the propulsion mechanism configured to draw liquid through the inlet port of the housing and into the outer sleeve when at least one of the housing or the expandable body is moved relative to the other in a first direction, the propulsion mechanism configured to draw liquid out of the outer sleeve, through the inner sleeve and into an interior region of the expandable body to move the expandable body from the collapsed configuration to the expanded configuration when at least one of the housing or the expandable body is moved relative to the other in a second direction different than the first direction, the expandable body and the housing being configured to be propelled while submerged within a body of fluid when the liquid is expelled from the expandable body.

17. The apparatus of claim 16, further comprising:

an exit port coupled to and in fluid communication with the expandable reservoir; and a valve coupled to the exit port, the valve being selectively movable between a closed configuration in which liquid is contained within the expandable reservoir and an open configuration in which liquid is expelled from the expandable reservoir.

18. The apparatus of claim 16, further comprising:

a buoyancy adjustment member coupled to the expandable reservoir.

19. An apparatus, comprising:

a body defining an interior region; and a propulsion mechanism coupled to the body, the propulsion mechanism including an expandable reservoir disposed within the interior region of the body, the expandable reservoir having elastomeric walls configured to contain a first volume of liquid, the propulsion mechanism configured to expel the first volume of liquid from the expandable reservoir for a time period to cause the apparatus to be propelled while the apparatus is submerged in a liquid, the body defining at least one vent along an outer surface of the body, the at least one vent in fluid communication with the interior region of the body in which the expandable reservoir is disposed, the vent allowing a second volume of liquid to be received within the interior region of the body such that the apparatus in its entirety maintains a neutral buoyancy disposed at a non-zero distance below a surface of the liquid in which the apparatus is disposed and substantially maintains a center of gravity of the body during the time period the liquid is being expelled from the expandable reservoir and the apparatus is propelled in the liquid.

20. The apparatus of claim 19, wherein the body includes a first portion and a second portion, at least one of the first portion or the second portion being movable relative to the other to draw liquid into the expandable reservoir.

21. The apparatus of claim 19, wherein the apparatus is configured to remain entirely submerged during the time period.

22. The apparatus of claim 19, further comprising:

a weight coupled to the body, the center of gravity of the body defined in part by the weight.

* * * * *

UNITED STATES PATENT AND TRADEMARK OFFICE

CERTIFICATE OF CORRECTION

PATENT NO. : 8,033,890 B2
APPLICATION NO. : 11/435286
DATED : October 11, 2011
INVENTOR(S) : Jon A. Warner et al.

It is certified that error appears in the above-identified patent and that said Letters Patent is hereby corrected as shown below:

Column 2, line 26, replace “OF THE INVENTION” with -- OF THE DRAWINGS --.

Column 4, line 19, replace “a toy” with -- the toy --.

Column 16, line 64, replace “quick-connect connect” with -- quick-connect --.

Column 24, line 63, replace “is” with -- in --.

Signed and Sealed this
Twenty-seventh Day of March, 2012

David J. Kappos

David J. Kappos
*Director of the United States Patent and Trademark Office*